US006712055B1

(12) United States Patent
Tidman

(10) Patent No.: US 6,712,055 B1
(45) Date of Patent: Mar. 30, 2004

(54) SPIRAL MASS LAUNCHER

(75) Inventor: Derek A. Tidman, McLean, VA (US)

(73) Assignee: Advanced Launch Corporation, McLean, VA (US)

( * ) Notice: Subject to any disclaimer, the term of this patent is extended or adjusted under 35 U.S.C. 154(b) by 0 days.

(21) Appl. No.: 10/091,025

(22) Filed: Mar. 6, 2002

Related U.S. Application Data

(60) Provisional application No. 60/273,640, filed on Mar. 7, 2001.

(51) Int. Cl.[7] ..... F41B 3/04
(52) U.S. Cl. ..... 124/6; 124/1; 74/86
(58) Field of Search ..... 74/86, 87; 89/8; 124/1, 3, 4, 6, 81

(56) References Cited

U.S. PATENT DOCUMENTS 2,644,270 A * 7/1953 Marong
2,684,062 A * 7/1954 Rose
3,185,479 A * 5/1965 Ortega
4,238,968 A * 12/1980 Cook
4,632,086 A * 12/1986 Rutten
4,881,446 A * 11/1989 Marks et al.
4,942,775 A * 7/1990 Monkewitz et al.
5,388,470 A * 2/1995 Marsh
5,699,779 A 12/1997 Tidman ..... 124/6
5,950,608 A 9/1999 Tidman ..... 124/6
6,014,964 A 1/2000 Tidman ..... 124/6

* cited by examiner

*Primary Examiner*—John A. Ricci
(74) *Attorney, Agent, or Firm*—Arent Fox Kintner Plotkin & Kahn, PLLC

(57) ABSTRACT

A spiral mass launcher is disclosed. The spiral mass launcher includes provisions that permit greater packing density and permit better support of a track. Some of these provisions include the use of specially designed angled swing arms. The spiral mass launcher also includes provisions to assist the spiral in achieving faster gyration speeds. Some of these provisions include improved arm designs and vacuum enclosures. A feed mechanism for a spiral mass launcher is also disclosed.

25 Claims, 34 Drawing Sheets

SPIRAL MASS LAUNCHER

RELATED APPLICATIONS

This application claims priority to U.S. provisional patent application No. 60/273,640, filed on Mar. 7, 2001, the entirety of which is incorporated by reference herein.

BACKGROUND

1. Field of the Invention

The present invention relates generally to a device that can move a mass, and more particularly, to an apparatus with a spiral track that can launch a mass.

2. Background of the Invention

Mass launchers are generally known. Some examples include U.S. Pat. No. 5,699,779 to Tidman, entitled "Method of and Apparatus for Moving a Mass," U.S. Pat. No. 5,950,608 to Tidman, entitled, "Method of and Apparatus for Moving a Mass," and U.S. Pat. No. 6,014,964 to Tidman, entitled, "Method and Apparatus for Moving a Mass in a Spiral Track", all of which are herein incorporated by reference in their entirety.

While these earlier mass launchers were serviceable, they did not permit higher gyration speeds because of structural disadvantages. For example, previous designs would have difficulty achieving higher gyration speeds because they would not be able to safely handle the forces imposed by those higher rotational rates. One drawback in the prior art devices is the inability to place clamps or joints, the devices that attach the spiral track to a support member, close together. Due to their shape and configuration, previous devices were required to place the clamps at certain minimum distances. Often, these distances would not provide enough support to permit higher gyration speeds.

Another problem facing previous designs is the aerodynamic or fluid dynamic drag. As the spiral track is gyrated at higher and higher speeds, drag would impose greater and greater loads on many of the components of the spiral mass launcher. Another problem facing spiral mass launchers is the lack of an adequate feed mechanism. One theoretical advantage of spiral mass launchers is their ability to provide a high rate of fire. However, previous designs could not achieve this advantage due to a lack of a suitable feed mechanism that would be able to deliver projectiles into the mass launcher at requisite rates.

SUMMARY OF THE INVENTION

The present invention is directed to a mass launcher with a spiral track. In one aspect, the invention includes an apparatus for moving a mass comprising a spiral track, a first arm assembly having a first fulcrum and a first front end, a second arm assembly having a second fulcrum and a second front end, wherein the distance between the first fulcrum and the second fulcrum is less than the length of the first arm assembly.

In another aspect, the invention includes an arrangement of arm assemblies where the distance between the clamps of two successive arms is less than the length of one of the arm assemblies.

In another aspect, the arm is tapered.

In another aspect, the first arm assembly includes only upper arms.

In another aspect, the first arm assembly includes only lower arms.

In another aspect, the invention includes an apparatus capable of moving a mass comprising a spiral track, a first arm assembly connected to the spiral track and having an upper arm. The upper arm having a first end and a second end, the first arm assembly also having a lower arm, the lower arm having a first end and a second end; and wherein the second end of the upper arm is separated from the second end of the lower arm.

In another aspect, the upper arm is connected to a first axle and the lower arm is connected to a second axle wherein the first axle is spaced from the second axle resulting in a space between the upper arm and the lower arm.

In another aspect, the second end of the lower arm includes a counterweight.

In another aspect, the invention includes an apparatus capable of moving a mass comprising a spiral track, a first arm assembly connected to the spiral track and having at least one arm, the arm having a first width proximate a first end and a second width proximate a second end, wherein the first width is different than the second width.

In another aspect, the arm includes a pivot region.

In another aspect, the arm includes a tapered region disposed between the first and second ends.

In another aspect, the arm includes a pivot region disposed between the first and second ends.

In another aspect, the invention includes an apparatus capable of moving a mass comprising a spiral track moving in a gyrating motion, the spiral track having a first end and a second end, the first end adapted to receive a mass and a second end adapted to launch a mass, wherein the first end being upstream of the second end, feed mechanism adapted to feed a mass into the first end of the spiral track, the feed mechanism including a feed inlet and a feed outlet, wherein the feed inlet is stationary and the feed outlet rotates.

In another aspect, the feed outlet is in flow communication with the first end of the spiral track.

In another aspect, the feed inlet includes a pivoting joint that permits the feed inlet to rotate with respect to a fixed feed inlet.

In another aspect, wherein the feed outlet includes a pivoting joint that permits the feed outlet to rotate with respect to the first end of the spiral track.

In another aspect, wherein the feed outlet is connected to the first end of the spiral track and moves with the spiral track.

In another aspect, wherein the feed mechanism includes a rotating member.

In another aspect, wherein the rotating member is connected to a gearbox and a motor.

In another aspect, wherein the feed inlet is disposed above the spiral track.

In another aspect, wherein the feed inlet is disposed below the spiral track.

In another aspect, further comprising an actuator adapted to move projectiles.

In another aspect, the invention includes an apparatus capable of moving a mass comprising a spiral track, a first arm assembly connected to the spiral track and having at least one arm, a portion of the first arm assembly capable of rotating with the arm, the motion of the portion defining a circle, a second arm assembly connected to the spiral track and having at least one arm, wherein a portion of the second arm passes within the circle.

In another aspect, the portion of the first arm is proximate to a first end.

In another aspect, the first arm assembly includes only upper arms.

In another aspect, the first arm assembly includes only lower arms.

In another aspect, successive arms are staggered.

In another aspect, the stagger comprises an upper arm followed by a lower arm.

In another aspect, the invention includes an apparatus capable of moving a mass located in an ambient atmosphere comprising: a spiral track moving in a gyrating motion, at least one drive device capable of moving the spiral track, an enclosure surrounding a portion of the spiral track and defining an interior volume, a vacuum device in fluid communication with the interior volume and with the ambient atmosphere, wherein the vacuum device creates a pressure difference between the interior volume and the ambient atmosphere.

In another aspect, the enclosure comprises at least one panel attached to a bracket.

In another aspect, the enclosure comprises a series of panels attached to various brackets.

In another aspect, the enclosure includes at least one aperture and wherein a plasma window is disposed proximate the aperture.

In another aspect, the plasma window assists in sustaining a pressure difference between the interior volume and the ambient atmosphere.

Additional features and advantages of the invention will be set forth in the description which follows, and in part will be apparent from the description, or may be learned by practice of the invention. The objectives and advantages of the invention will be realized and attained by the structure and steps particularly pointed out in the written description, the claims and the drawings.

DETAILED DESCRIPTION OF THE PREFERRED EMBODIMENT(S)

FIGS. 1A–4B demonstrate the preferred motion of a mass launcher or spiral 102. FIGS. 1A–4B show four positions of spiral 102 with respect to a relatively stationary frame of reference or ground 104. Because it can be difficult to perceive the motion of spiral 102, rotating mass 106, shown in FIGS. 1A, 2A, 3A and 4A, is used to demonstrate the various positions of spiral 102 as it gyrates. The angular position of the spiral 102 shown in FIG. 1B corresponds to the angular position of the rotating mass 106 shown in FIG. 1A. Likewise, the angular position of the spiral 102 shown in FIG. 2B corresponds to the angular position of the rotating mass 106 shown in FIG. 2A. This is also true for FIGS. 3A and 3B and for FIGS. 4A and 4B.

Figure 1A:
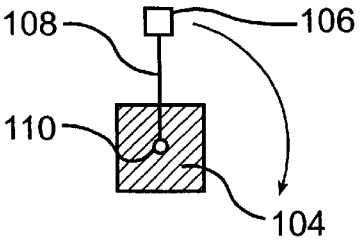
FIG. 1A is a schematic diagram of a rotating mass in a first position.

Referring to FIG. 1A, consider a simple moving member 106 rotating about an axis 110, with axis 110 being attached to a relatively stationary ground 104. The moving member 106 is connected to axis 110 by arm 108. Assuming that axis 110 permits arm 108 to rotate about axis 110, moving member 106 will in turn rotate about axis 110.

Figure 1B:
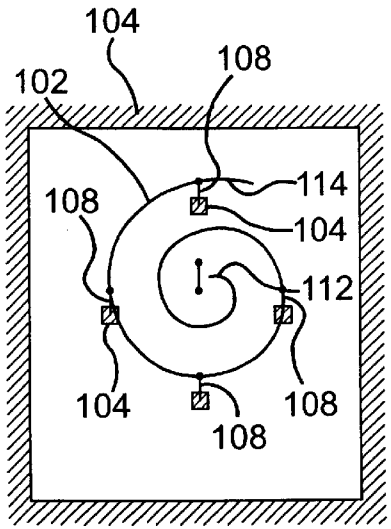
FIG. 1B is a schematic diagram of a preferred embodiment spiral mass launcher in a first position accordance with the present invention.

FIG. 1A shows the moving member 106 in the 12:00 o'clock position and FIGS. 2A–4B describe or show the rotation of the moving member in a generally clockwise matter. FIG. 1B shows a mass launcher 102 supported by a plurality of arms 108. FIG. 1B corresponds to FIG. 1A and FIG. 1B shows the mass launcher 102 and a 12 o'clock orientation. Mass launcher 102 is shown within ground 104. Viewing the mass launcher 102 relative to the frame of ground 104, it is possible to visualize the relative position and the motion of mass launcher 102 with respect to ground 104.

Figure 2A:
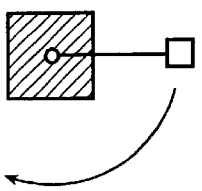
FIG. 2A is a schematic diagram of a rotating mass in a second position.
Figure 2B:
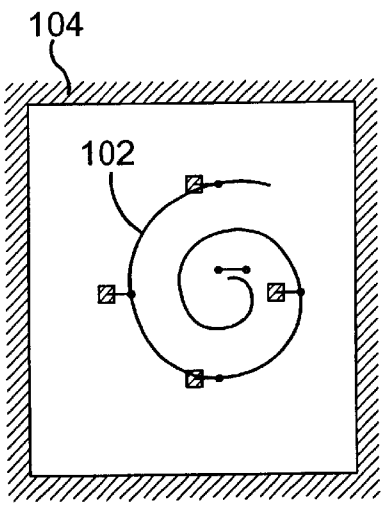
FIG. 2B is a schematic diagram of a preferred embodiment spiral mass launcher in a second position accordance with the present invention.
Figure 3A:
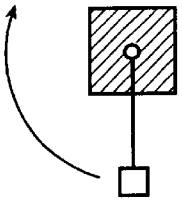
FIG. 3A is a schematic diagram of a rotating mass in a third position.
Figure 3B:
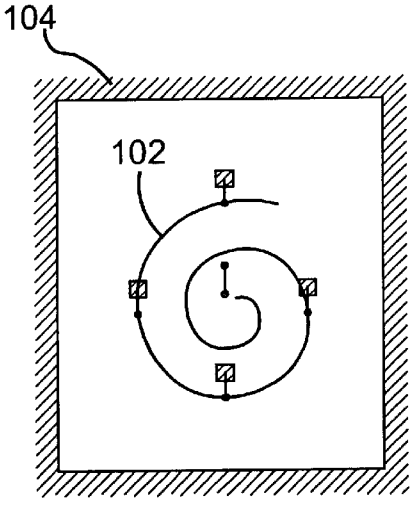
FIG. 3B is a schematic diagram of a preferred embodiment spiral mass launcher in a third position accordance with the present invention.
Figure 4A:
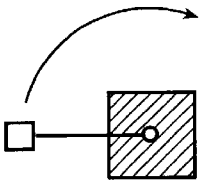
FIG. 4A is a schematic diagram of a rotating mass in a fourth position.
Figure 4B:
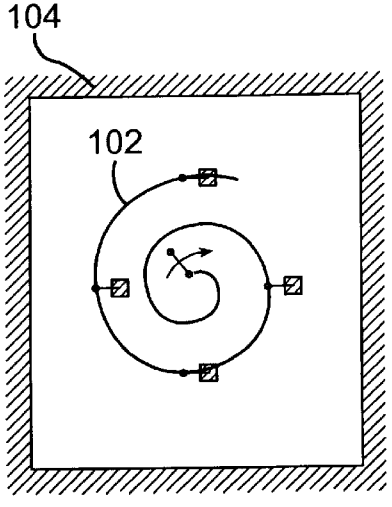
FIG. 4B is a schematic diagram of a preferred embodiment spiral mass launcher in a fourth position accordance with the present invention.

FIG. 2A shows moving member 106 in the 3 o'clock position relative to axis 110 and ground 104. FIG. 2B corresponds to FIG. 2A and shows mass launcher 102 in the 3 o'clock position. FIGS. 3A and 3B show the mass launcher in the 6 o'clock position and FIGS. 4A and 4B show the moving member 106 and mass launcher 102 in the 9 o'clock position.

Notice that, in this preferred embodiment, mass launcher 102 does not rotate about an axis but rather gyrates relative to ground 104. In other words mass launcher 102 does not spin about a central axis, but rather mass launcher 102 gyrates relative to ground 104. The motion of mass launcher 102 can also be described as being an orbital motion.

Spiral or mass launcher 102 is preferably comprised of a track with a hollow or U-shaped channel and includes openings or access points at both ends. Mass launcher 102 includes a first end 112 disposed in a central portion of mass launcher 102 and a second end 114 disposed on an outer periphery of mass launcher 102. Preferably, a mass or projectile (not shown in FIGS. 1A to 4B) enters the first end 112. As mass launcher 102 moves in the manner described above, the mass is subjected to various forces and the motion of mass launcher 102 tends to move the mass around the track towards second end 114.

In FIGS. 1A–4B, four arms 108 hold mass launcher 102. In some embodiments, more arms 108 are used to hold mass launcher 102, and in other embodiments, less arms 108 are used to support mass launcher 102. However, it is preferred that more than four arms 108 are used to support mass launcher 102.

Figure 5:
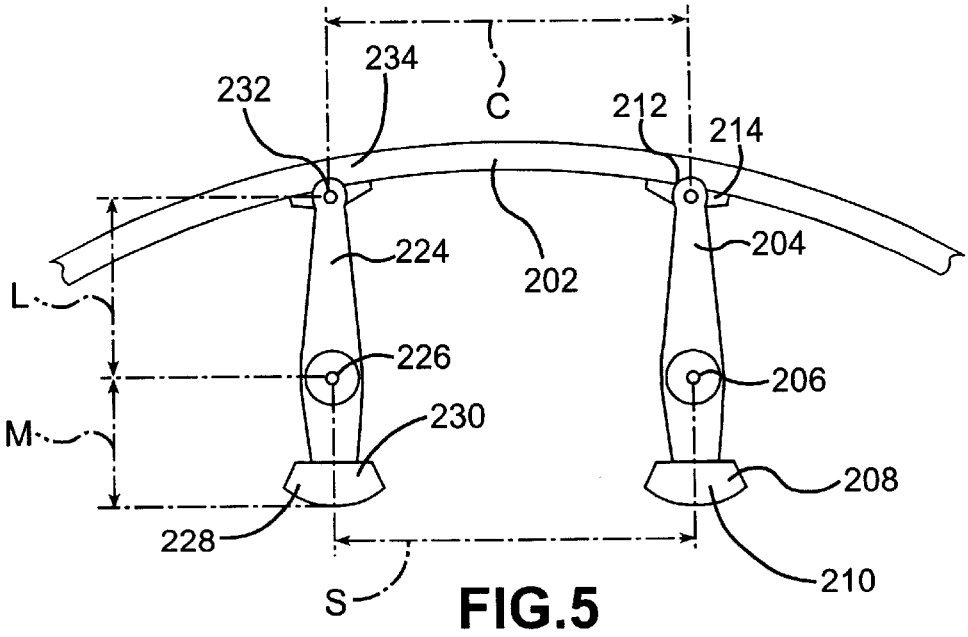
FIG. 5 is a schematic diagram of a demonstrative pair of arms.

Turning to FIG. 5, which shows a schematic top view of a track 202 and two arms, a first arm 204 and a second arm 224, the relative spacing between first arm 204 and second arm 224 is shown. In this embodiment, first arm 204 includes a first fulcrum 206, about which first arm 204 rotates.

First arm 204 includes a first end 212,and associated with first end 212 of first arm 204 is a is first clamp 214. First clamp 214 is designed to connect first arm 204 with track 202. The opposite end of arm 204; second end 210, includes a first counterweight 208.

Second arm 224 includes a second fulcrum 226, about which second arm 224 rotates. Second arm has a first and 232 end a second clamp) 234 associated with the first end 232 of second arm 224. Second arm also includes a second end 230 with a second counterweight 228 associated with second end 230 of second arm 224. As shown in the figures, the distance between first fulcrum 206 and second fulcrum 226 is a distance S. The distance from a fulcrum to the first end is a distance L and a distance from the fulcrum to the second end is a distance M.

Due to the high rotational speeds and the high stresses imposed on track 202 by the gyrating motion, it is generally desirable to place the clamps associated with the arms as close together as possible on track 202. In other words, in some embodiments, it is desirable to reduce the local circumferential distance C. In the embodiment shown in FIG. 5, the local circumferential distance C is the distance between a portion of first clamp 214 and a portion of second clamp 234.

Figure 6:
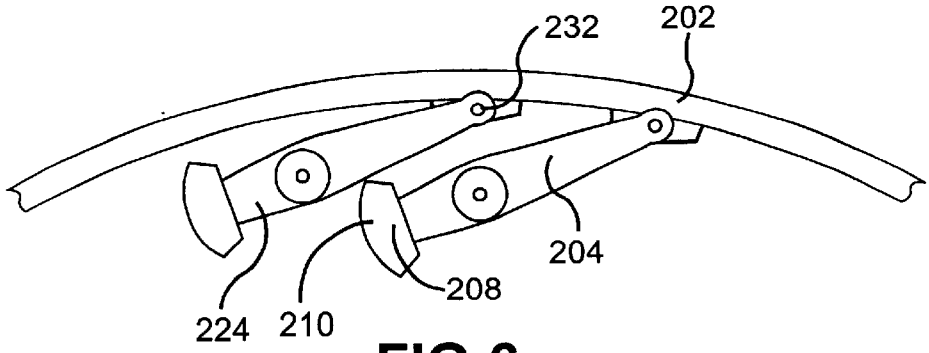
FIG. 6 is a schematic diagram of a demonstrative pair of arms showing a contact or interference.

One approach to reducing the distance C, which is the local circumferential distance between two successive clamps, is to reduce the distance S, namely, the distance between two adjacent fulcrums. As shown in FIG. 6, if this distance S is reduced too much, an impact or interference could occur. In the embodiment shown in FIG. 6, the distance S is so short that the second end 210 of first arm 204 which includes counterweight 208, contacts a portion of second arm 224.

Figure 7:
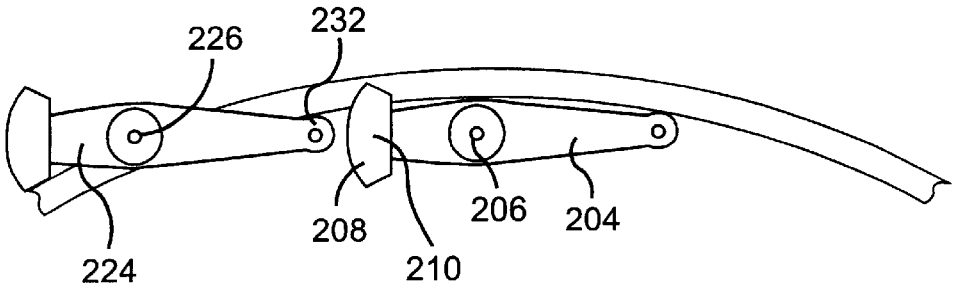
FIG. 7 is a schematic diagram of a preferred embodiment of a pair of arms in accordance with the present invention.

FIG. 7 shows an appropriate spacing configuration for first arm 204 and second arm 224. As shown in FIG. 7, appropriate spacing is achieved by ensuring that the distance S, which is the distance between first fulcrum 206 and second fulcrum 226 is larger than the distance L, which is the distance between a fulcrum and a first end of an arm, and the distance M which is the distance between the second end of an arm and a fulcrum as shown in FIG. 7. In other words, S must be greater than L plus M.

The embodiment shown in FIG. 7 may provide adequate spacing in some applications, however, there may be applications, for example, those applications that require higher gyration speeds, that have higher rates of fire, that require higher muzzle velocities, or that launch more massive projectiles, that require even closer spacing of clamps 214 and 234. In other words, there may be times when it is important to reduce the distance C to a point where S is less than L+M. The two dimensional embodiment of FIG. 7 does not permit such a spacing. However, the following embodiment does.

Figure 8A:
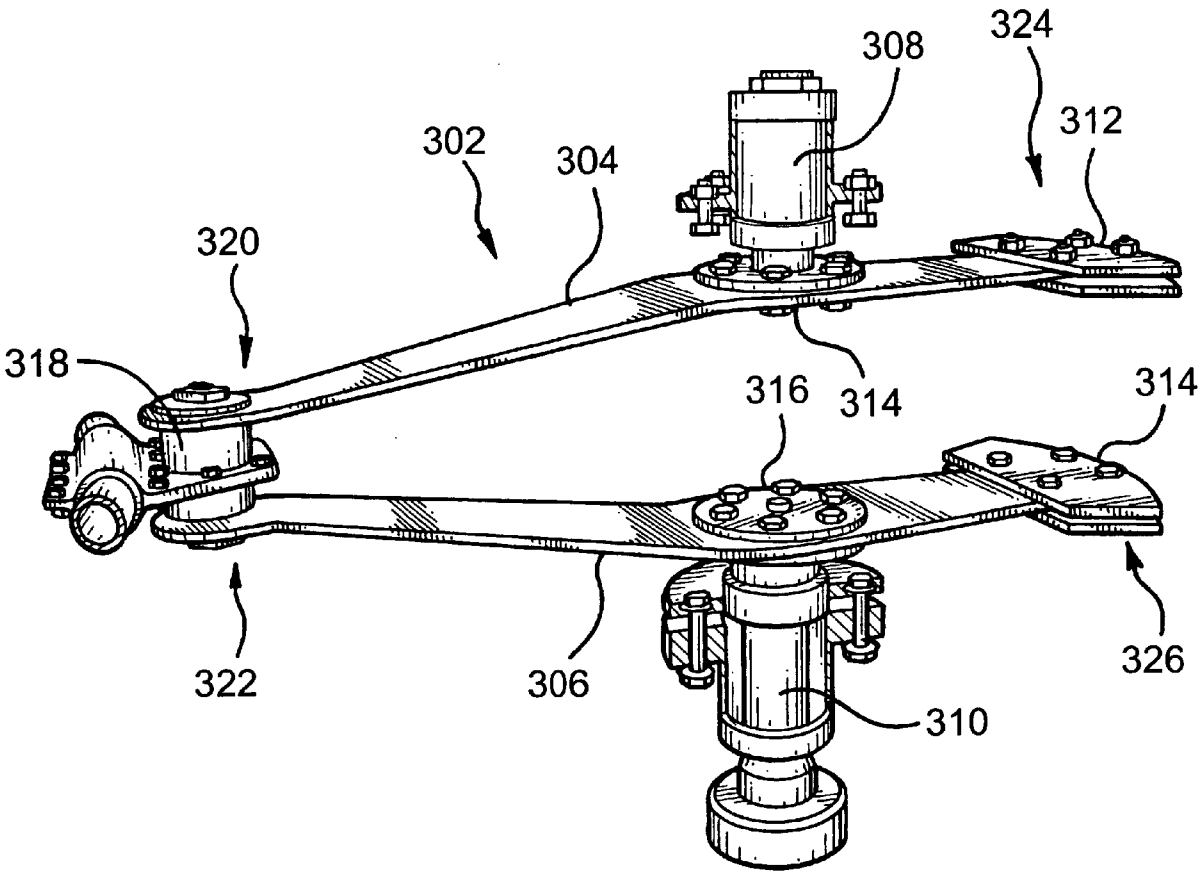
FIG. 8A is an isometric diagram of a preferred embodiment of a swing arm assembly in accordance with the present invention.

FIG. 8A shows an isometric view of first arm assembly 302 in accordance of with a preferred embodiment of the present invention. First arm assembly 302 includes an upper arm 304 and a lower arm 306. The upper arm is connected to an upper shaft 308 by a suitable rotating mechanical coupling. Upper shaft 308 defines a upper fulcrum 314. Upper arm 304 includes a first end 320 and second end 324. At first end 320 upper arm 304 is attached to a coupler 318. Preferably coupler 318 is able to rotate with respect to upper arm 304. Second end 324 or first arm assembly 302 includes an upper counter weight 312.

Lower arm 306 is preferably structurally similar to upper arm 304, and in an exemplary embodiment, as shown in FIG. 8, lower arm 306 is a mirror image of upper arm 304. Lower arm is rotatably mounted with respect to a lower shaft 310. In some embodiments, lower shaft 310 defines a lower fulcrum 316. Lower arm 306 rotates about an axis defined by lower fulcrum 316. Lower arm also includes a first end 322 and a second end 326. The first end 322 of lower arm 306 is connected to a coupler 318. Preferably coupler 318 is able to rotate with respect to lower arm 306. Second end 326 of lower arm 306 includes a lower counter weight 314.

Preferably coupler 318 extends between first end 320 of upper arm 304 and first end 322 of lower arm 306. Suitable bearings and other mechanical connectors permit coupler 318 to rotate about upper arm 304 and lower arm 306. Preferably upper fulcrum 314 and lower fulcrum 316 are aligned so that the upper arm 304 and lower arm 306 rotate about a common axis.

Figure 8B:
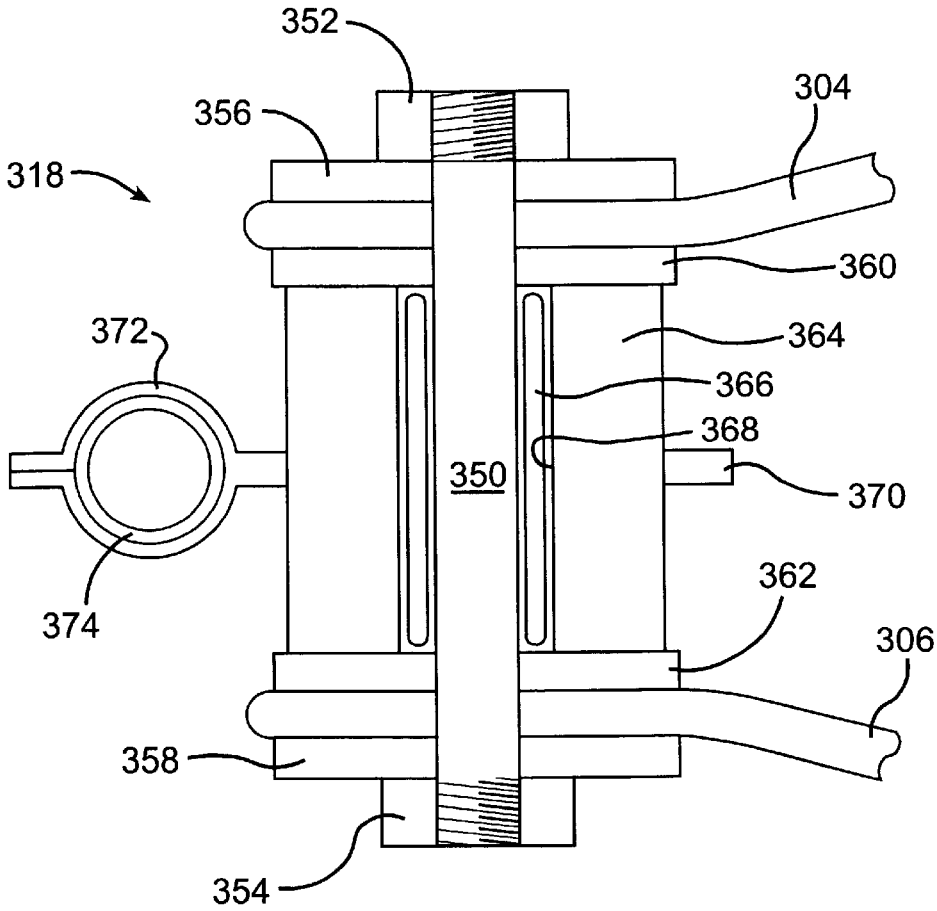
FIG. 8B is a cross-sectional view of a preferred embodiment of a coupler in accordance with the present invention.

FIG. 8B shows an enlarged, cross-sectional view of coupler 318. As previously disclosed, coupler 318 is preferably used to join the upper arm 304 and the lower arm 306 of first arm assembly 302 with clamp 372. Clamp 372 is used to retain track 374. Other devices used to hold a track could also be used with coupler 318.

Coupler 318 permits clamp 372 and track 374 to rotate in relation to upper arm 304 and lower arm 306. Many different arrangements can be used to accomplish this respective rotation. However, the following arrangement is preferred.

Preferably, a central shaft 350 is attached to upper arm 304 by upper nut 352. Preferably, a washer 356 is disposed between upper nut 352 and upper arm 304. Similarly, the lower portion of shaft 350 is attached to lower arm 306 by lower nut 354. Preferably, a washer 358 is disposed between lower nut 354 and lower arm 306. In this arrangement, upper arm 304, lower arm 306 and shaft 350 are rigidly related and do not rotate with respect to each other.

Collar 364 is located between upper arm 304 and lower arm 306 and coaxial with shaft 350. Collar 364 is attached to clamp 372, preferably by flange 370. In order to accommodate rotation between collar 364 and arms 304, 306 and shaft 350, bearings are used. Preferably, needle bearings 366 are disposed between collar 364 and shaft 350. Any type of bearings could be used, but full length needle bearings 366 that operate within bearing race 368 formed on an interior surface of collar 364 are used. Thrust bearings 360 and 362 are used between collar 364 and upper arm 304 and lower arm 306, respectively.

Figure 9:
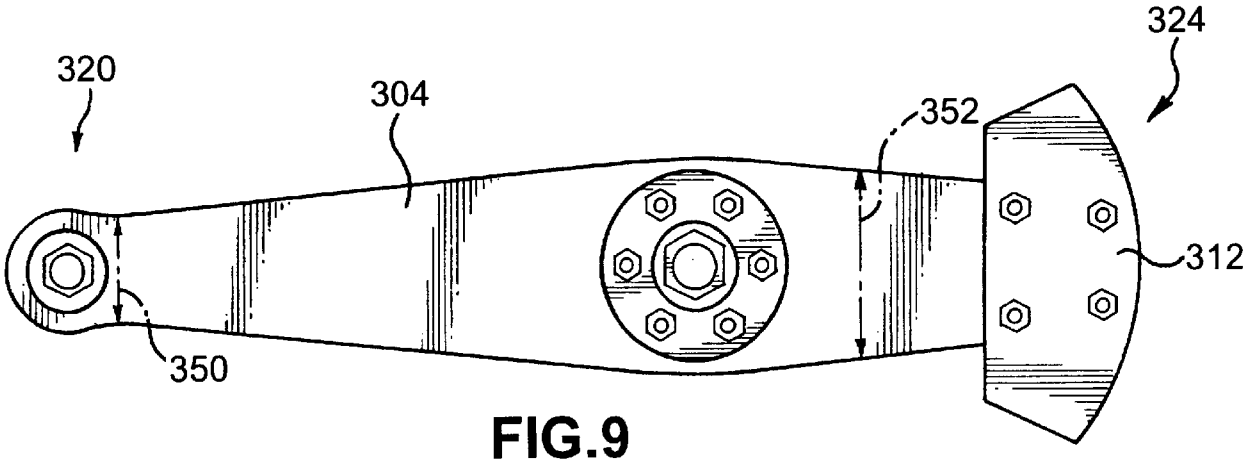
FIG. 9 is a top view of a preferred embodiment of an arm in accordance with the present invention.

FIG. 9 shows a top view of upper arm 304. First a region near first end 320 includes a width 350 and second end 324 includes a region including a width of 352. Preferably second end 324 is proximate to upper counter weight 312. While, in some embodiments width 350 may be equal to width 352, it is preferred that width 350 is smaller than width 352. In other words, upper arm 304 is tapered toward first end 320. This taper reduces the rotational mass of the arm and also assists in providing mass balance throughout the life of the arm.

Figure 10:
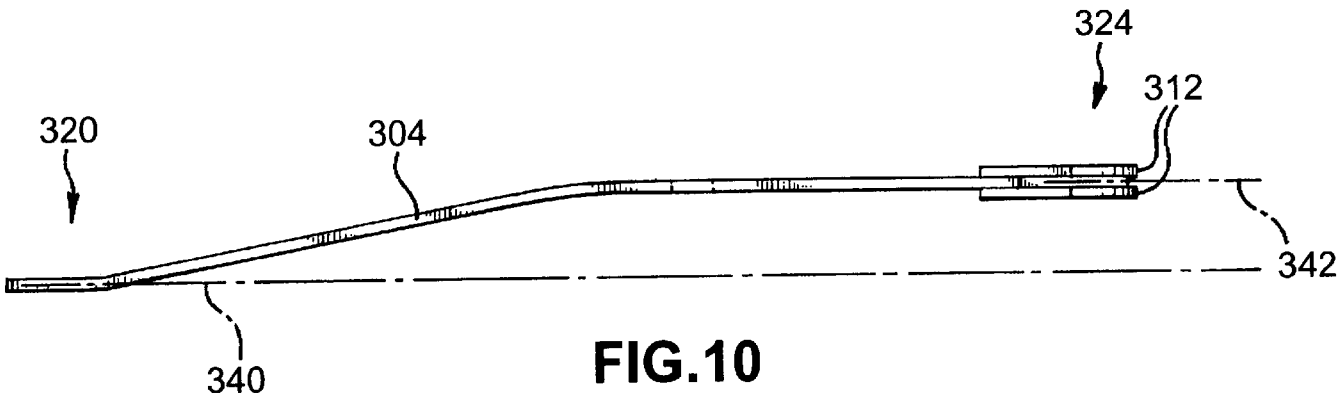
FIG. 10 is a side view of a preferred embodiment of an arm in accordance with the present invention.

FIG. 10 shows a side view of upper arm 304. As shown in FIG. 10, a region proximate to first end 320 is disposed at a first vertical height 340 and a region proximate to second end 324 is disposed at a second vertical position of 342. Preferably first vertical position 340 is different than second position 342. In an exemplary embodiment of the invention, as shown in FIG. 10, second vertical position 342 is vertically above first vertical position 340. For lower arm 306, this arrangement would be reversed. In other words, in lower arm 306, first end 322, referring to FIG. 8A, would be at a first vertical position while second end 326 of lower arm 306 would be at a second vertical position. For lower arm 306, first vertical position 326 would be below the vertical position of first end 322.

Another way to define the relative vertical locations for both the upper arm and the lower arm, is to understand that first end 320 and 322 are both in vertical positions which are closer to coupler 318 than second end 324 of upper arm 304 and second end 326 of lower arm 306. In other words, as clearly shown in FIG. 8A, the first ends are always vertically closer to the coupler than the second ends.

Figure 11:
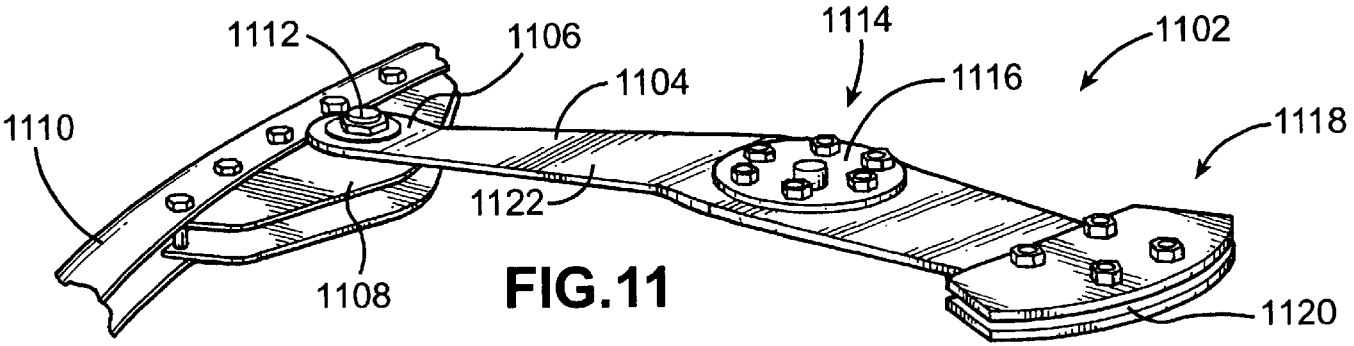
FIG. 11 is an isometric view of an upper arm assembly embodiment in accordance with the present invention.

FIG. 11 shows an isometric view of another embodiment of a swing arm assembly 1102. In this embodiment, swing arm assembly 1102 comprises only an upper arm 1104 and does not include a lower arm. First end 1106 of swing arm assembly 1102 is attached to flange 1108 associated with track 1110 by a suitable connection 1112. Swing arm assembly 1102 also includes a pivot region 1114 that includes a suitable provisions 1116 that permit swing arm assembly 1102 to be connected to and rotate about a generally fixed frame (not shown). Swing arm assembly also includes a second end 1118 that includes a counter weight 1120.

In this embodiment, swing arm assembly 1102 only includes an upper arm 1104 and omits a lower arm. Thus, first end 1106 is disposed in a plane that is fairly close to the plane of gyration of track 1110. Both pivot region 1114 and second end 1118 are preferably located in a plane that is different than the plane where first end 1106 is located. Preferably pivot region 114 and second end 1118 are in the same plane and preferably, that plane is disposed above the plane where the first end 1106 is located. In order to insure that the first end 1106 and second end 1118 are located in different planes, swing arm assembly 1102 preferably includes an angled region 1122 disposed between first end 1106 and second end 1118. Angled region 1122 is preferably angled with respect to a horizontal line and serves to vertically space the first end 1106 from the second end 1118.

Figure 12:
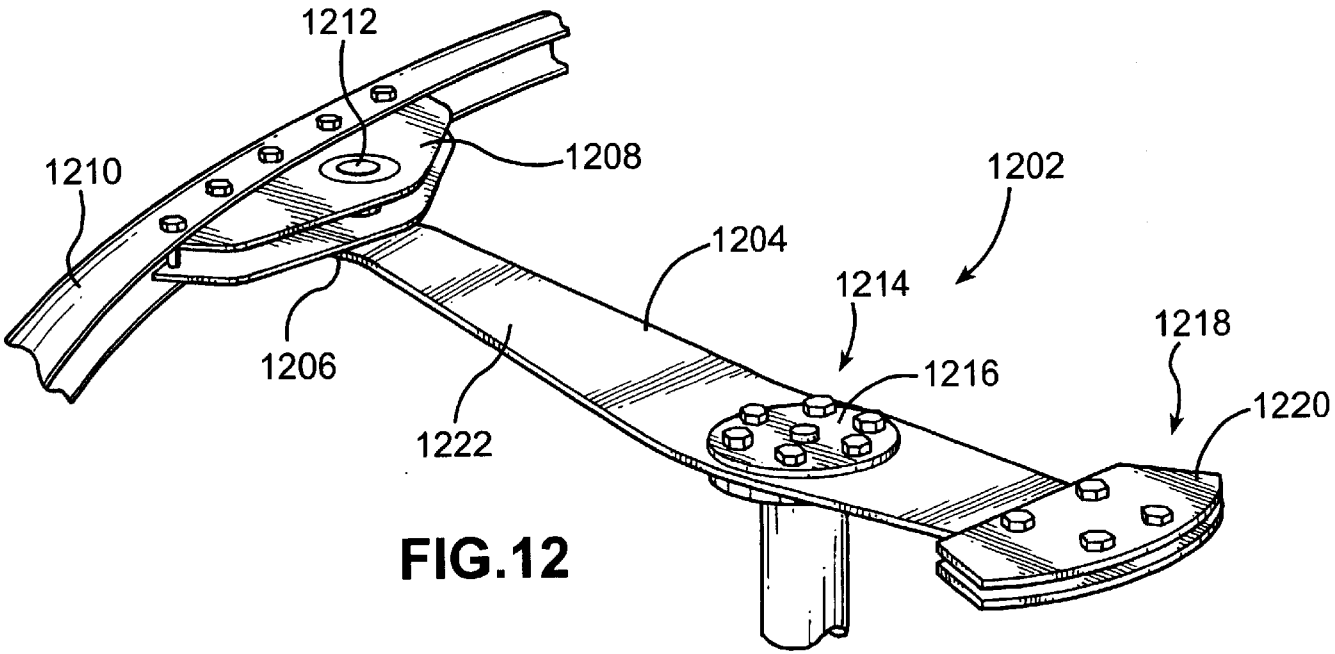
FIG. 12 is an isometric view of a lower arm assembly embodiment in accordance with the present invention.

FIG. 12 shows an isometric view of another embodiment of a swing arm assembly 1202. In this embodiment, swing arm assembly 1202 comprises only a lower arm 1204 and does not include an upper arm. First end 1206 of swing arm assembly 1202 is attached to flange 1208 associated with track 1210 by a suitable connection 1212. Swing arm assembly 1202 also includes a pivot region 1214 that includes a suitable provisions 1216 that permit swing arm assembly 1202 to be connected to and rotate about a generally fixed frame (not shown). Swing arm assembly also includes a second end 1218 that includes a counter weight 1220.

In this embodiment, swing arm assembly 1202 only includes a lower arm 1204 and omits an upper arm. Thus, first end 1206 is disposed in a plane that is fairly close to the plane of gyration of track 1210. Both pivot region 1214 and second end 1218 are preferably located in a plane that is different than the plane where first end 1206 is located. Preferably, pivot region 1214 and second end 1218 are in the same plane and preferably, that plane is disposed below the plane where the first end 1206 is located. In order to insure that the first end 1206 and second end 1218 are located in different planes, swing arm assembly 1202 preferably includes an angled region 1222 disposed between first end 1206 and second end 1218. Angled region 1222 is preferably angled with respect to a horizontal line and serves to vertically space the first end 1206 from the second end 1218.

Figure 13:
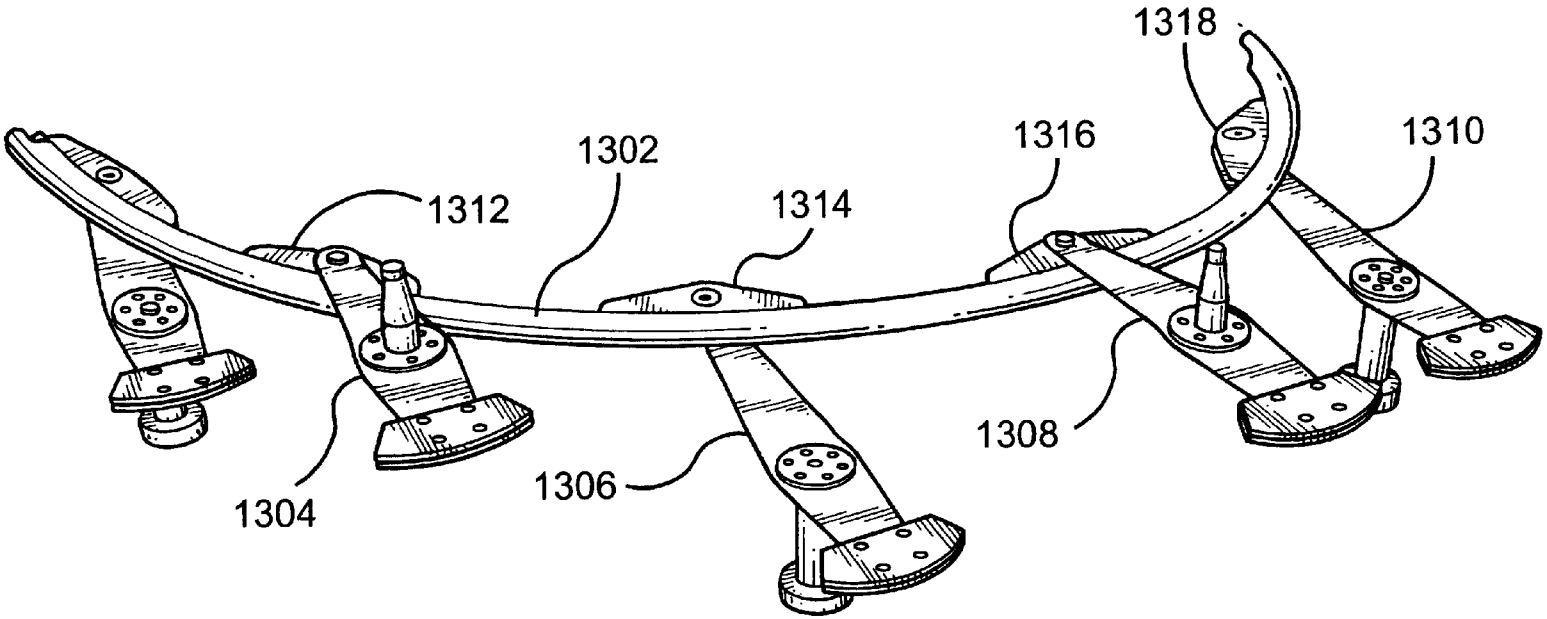
FIG. 13 is an isometric view of a preferred embodiment of a staggered arm arrangement in accordance with the present invention.

FIG. 13 is an isometric view of another embodiment of the present invention. In this embodiment, track 1302 is supported by a series of swing arms. The first swing arm 1304 extends above track 1302, second swing arm 1306 extends below track 1302, third swing arm 1308 extends above track 1302 and fourth swing arm 1310 extends below track 1302. Other swing arms could also be included, preferably, they would continue the pattern established by the first, second, third and fourth swing arms. Generally, as shown in FIG. 13, the swing arms can be disposed in a staggered formation with swing arms alternating above and below track 1302. This configuration helps to improve packing efficiency and also permits the clamps 1312, 1314, 1316 and 1318 associated with the first through fourth swing arms, respectively, to be closer to one another along track 1302. The close spacing helps to support track 1302 more securely.

To demonstrate the packaging efficiency achieved by applying the principles of the present invention, FIGS. 14–23 show various positions of two adjacent swing arm assemblies 1402 and 1404. These swing arm assemblies 1402 and 1404 are similar to the swing arm assembly shown in FIG. 8A. Both of the swing arm assemblies hold a common track 1406. First swing arm assembly 1402 has a first end 1410 that includes provisions to engage track 1406 and a second end 1412 opposite first end 1410. Second end 1412 preferably includes a counter weight. First swing arm assembly 1402 is preferably comprised of an upper arm 1414 and a lower arm 1416. A fulcrum 1418 is centrally located in the first swing arm assembly 1402.

Preferably, second swing arm assembly 1404 is similar to first swing arm assembly 1402. Thus, second swing arm assembly 1404 includes a first end 1430 that includes provisions to engage track 1406 and a second end 1432 opposite first end 1430. Second end 1432 preferably includes a counter weight. Second swing arm assembly 1404 is preferably comprised of an upper arm 1434 and a lower arm 1436. A fulcrum 1438 is centrally located in the first swing arm assembly 1402.

Figure 14:
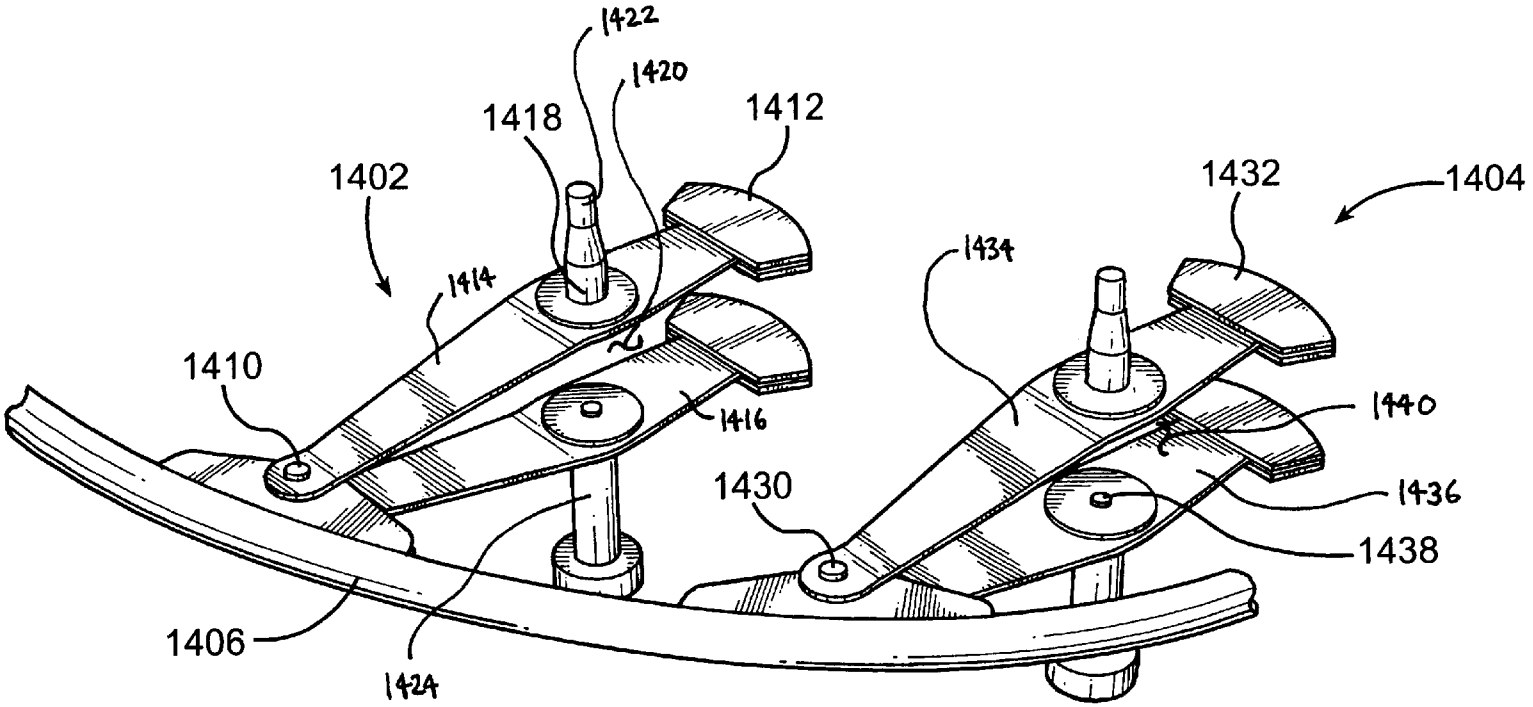
FIG. 14 is an isometric view of a preferred embodiment of a pair of arm assemblies at a first angular position in accordance with the present invention.
Figure 15:
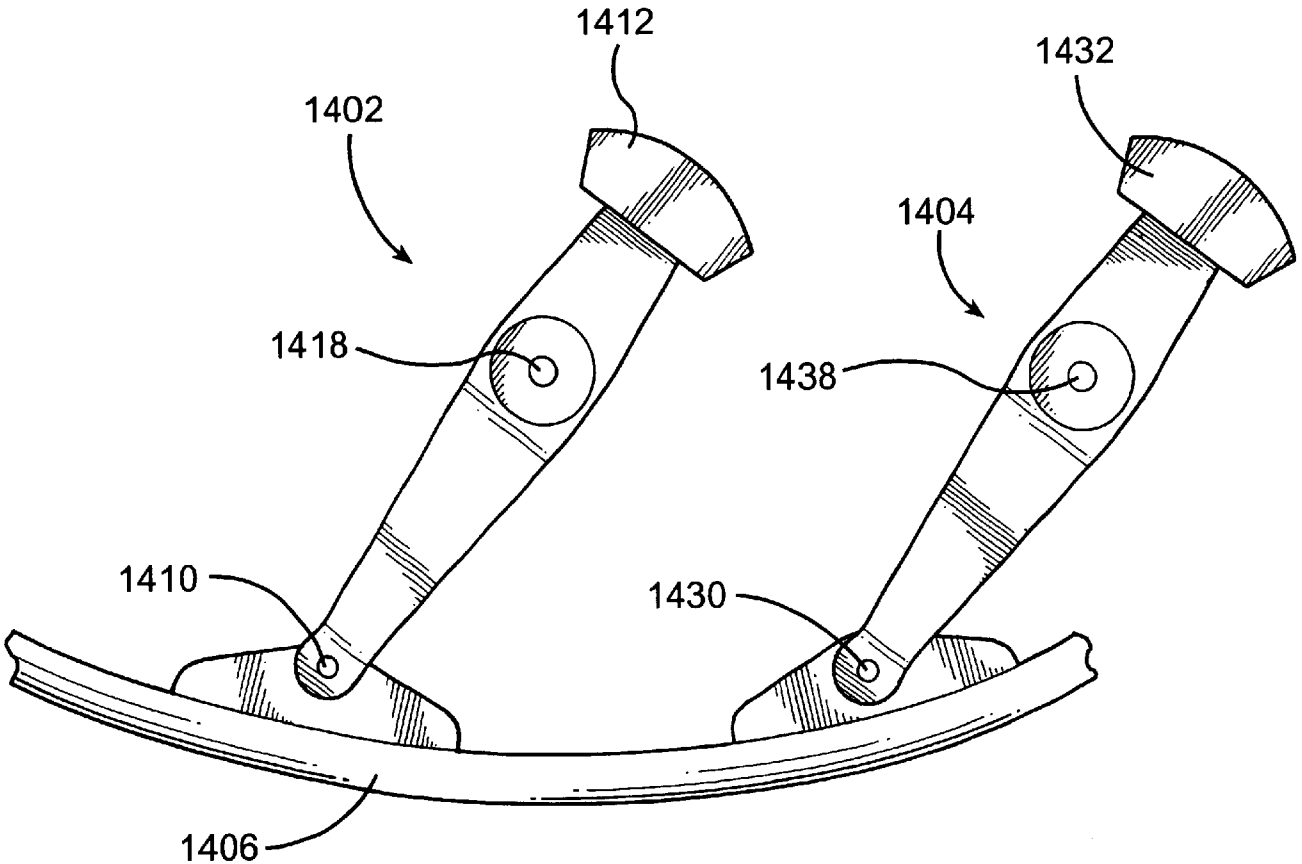
FIG. 15 is a schematic top view of a preferred embodiment of a pair of arm assemblies at a first angular position in accordance with the present invention.

In the embodiment shown in FIG. 14, the two swing arm assemblies 1402 and 1404 rotate in a clockwise direction. FIGS. 14 and 15 show the position of the two swing arm assemblies 1402 and 1404 as the second swing arm assembly 1404 is approaching the first swing arm assembly 1402.

Figure 16:
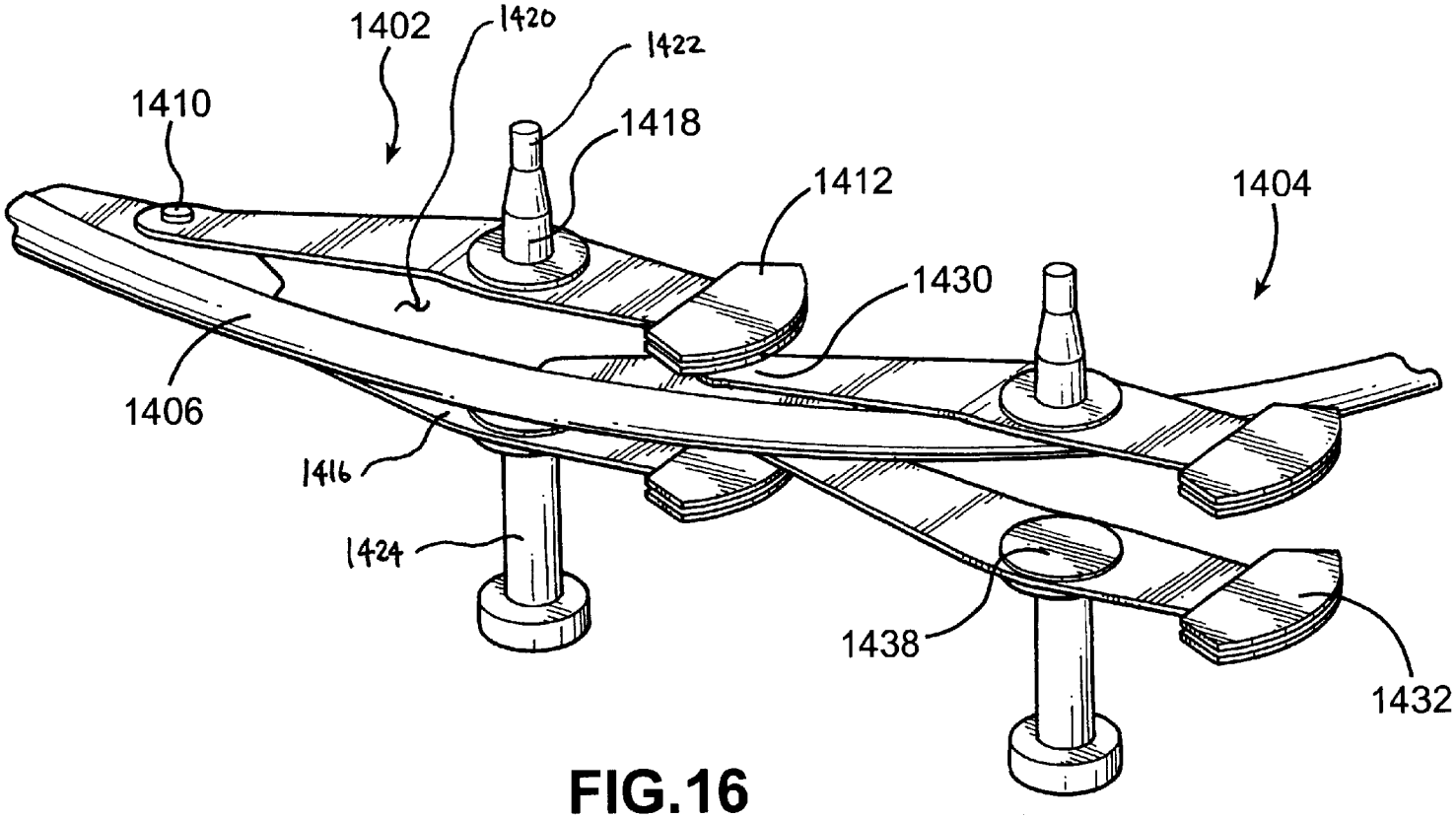
FIG. 16 is an isometric view of preferred embodiment of a pair of arm assemblies at a second angular position in accordance with the present invention.
Figure 17:
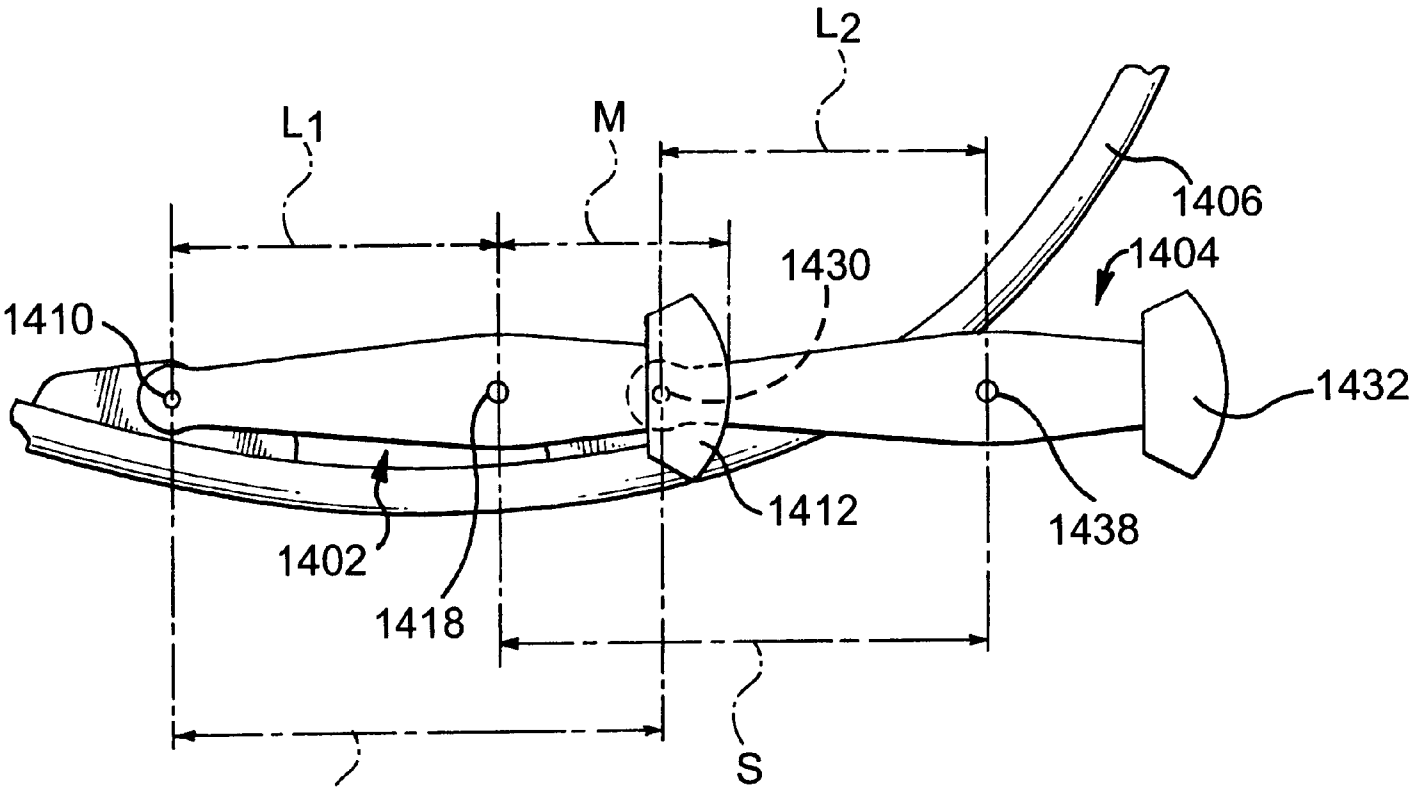
FIG. 17 is a schematic top view of a preferred embodiment of a pair of arm assemblies at a second angular position in accordance with the present invention.

FIGS. 16 and 17 show the position of the two swing arms 1402 and 1404 as second swing arm 1404 passes inside the first swing arm assembly 1402. Because of the design of the swing arm assemblies 1402 and 1404, specifically, the spacing, 1420 in first swing arm assembly 1402 and 1440 in second swing arm assembly 1404, between respective upper and lower arms, second swing arm assembly 1404 can pass through first swing arm assembly 1402.

The design of fulcrum 1418 also provides clearance for second arm assembly 1404. Fulcrum 1418 preferably does not include an interior axle or shaft. Preferably, first arm assembly 1402 is mounted by the use of two exterior half shafts 1422 and 1424. These half shafts 1422 and 1424 are attached to respective upper 1414 and lower 1416 arms and do not intrude into the interior space 1420 of first arm assembly 1402. This design permits second arm assembly 1404 to enter deeper into interior space 1420 of first arm assembly 1402.

Referring to FIG. 17, the reduction in S and the corresponding reduction in C can be observed. Recall that S is the distance between successive fulcrums. In the example shown in FIG. 17, S is the distance between first fulcrum 1418 and second fulcrum 1438. First arm assembly 1402 has a distance L1 from first end 1410 to fulcrum 1418 and first arm assembly 1402 has a distance M from fulcrum 1418 to second end 1412. The entire length of first arm assembly 1402 can be expressed as L+M. In the embodiment shown in FIG. 7, the distance S is greater than L+M, however, in the embodiment shown in FIG. 17, the distance S is noticeably less than L+M. This is because, as shown in FIG. 16 and 18, second arm assembly 1404 can enter and rotate within first arm assembly 1402.

Figure 18:
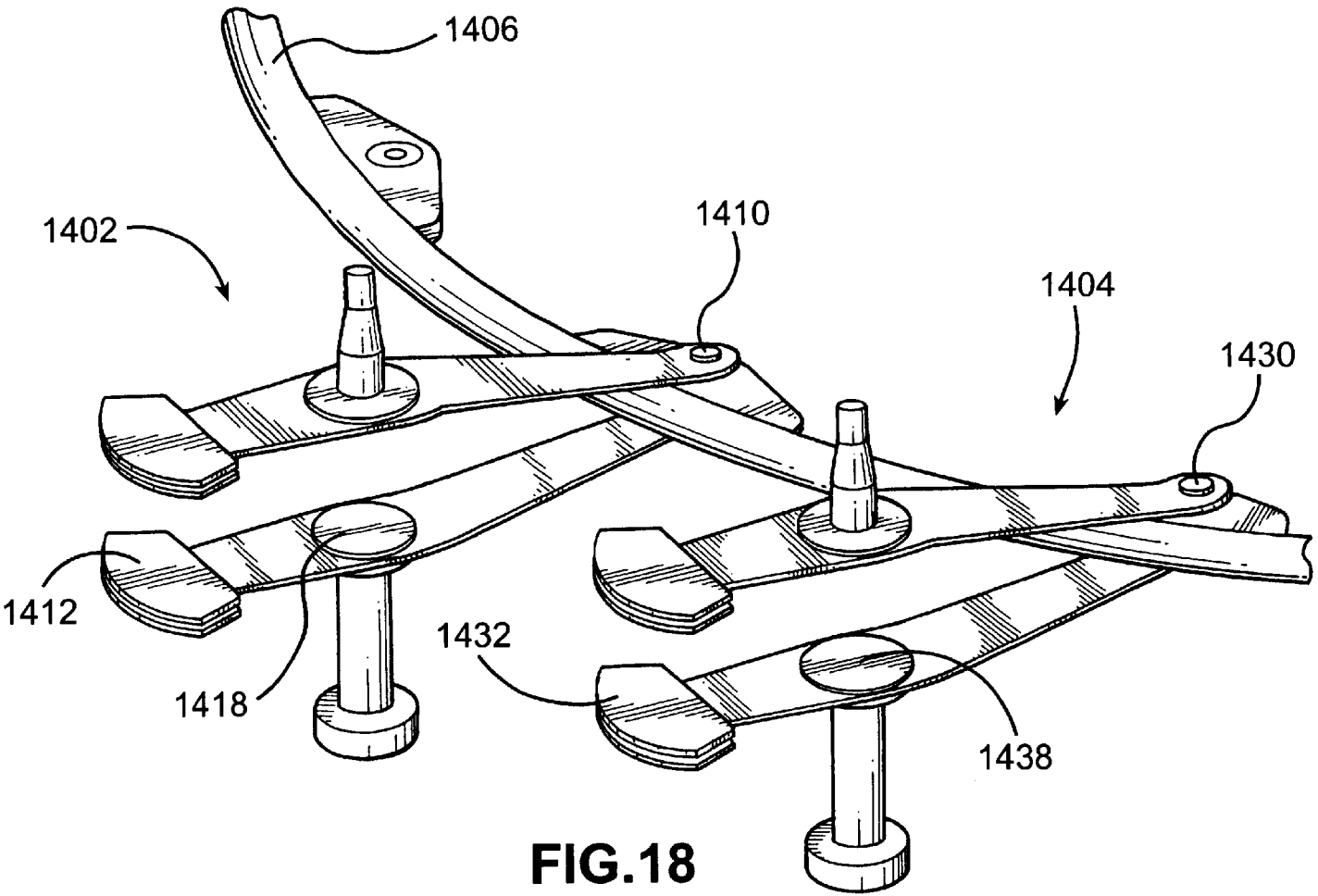
FIG. 18 is an isometric view of a preferred embodiment of a pair of arm assemblies at a third angular position in accordance with the present invention.
Figure 19:
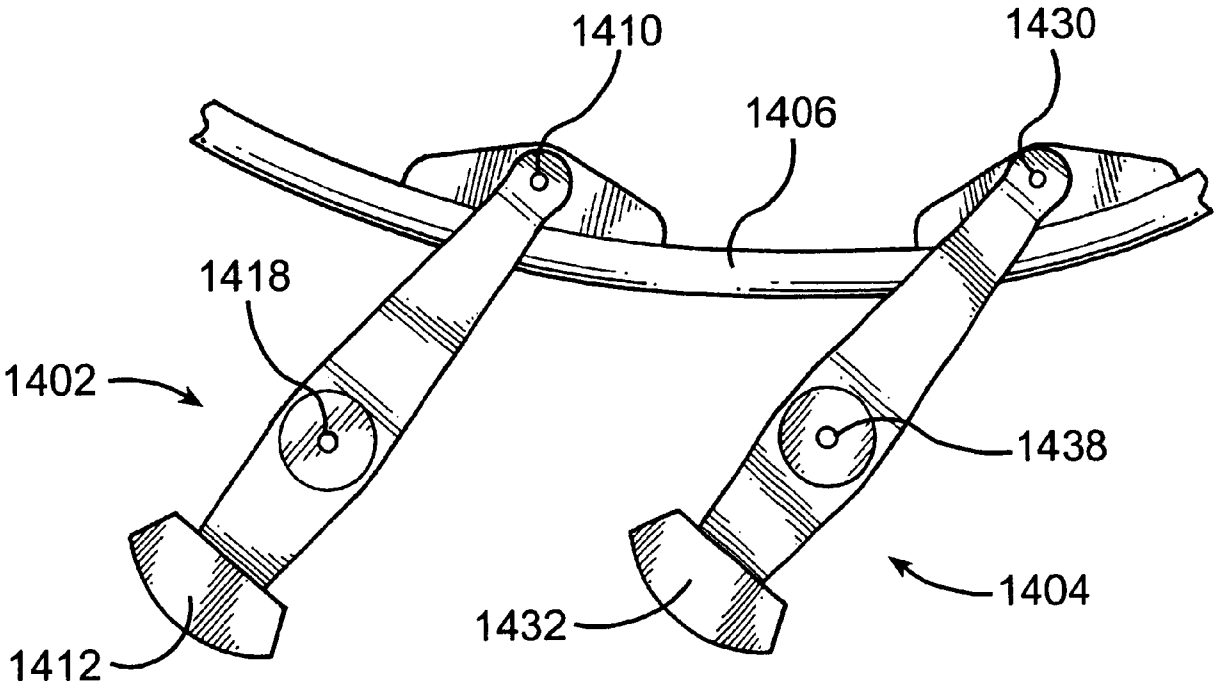
FIG. 19 is a schematic top view of a preferred embodiment of a pair of arm assemblies at a third angular position in accordance with the present invention.
Figure 20:
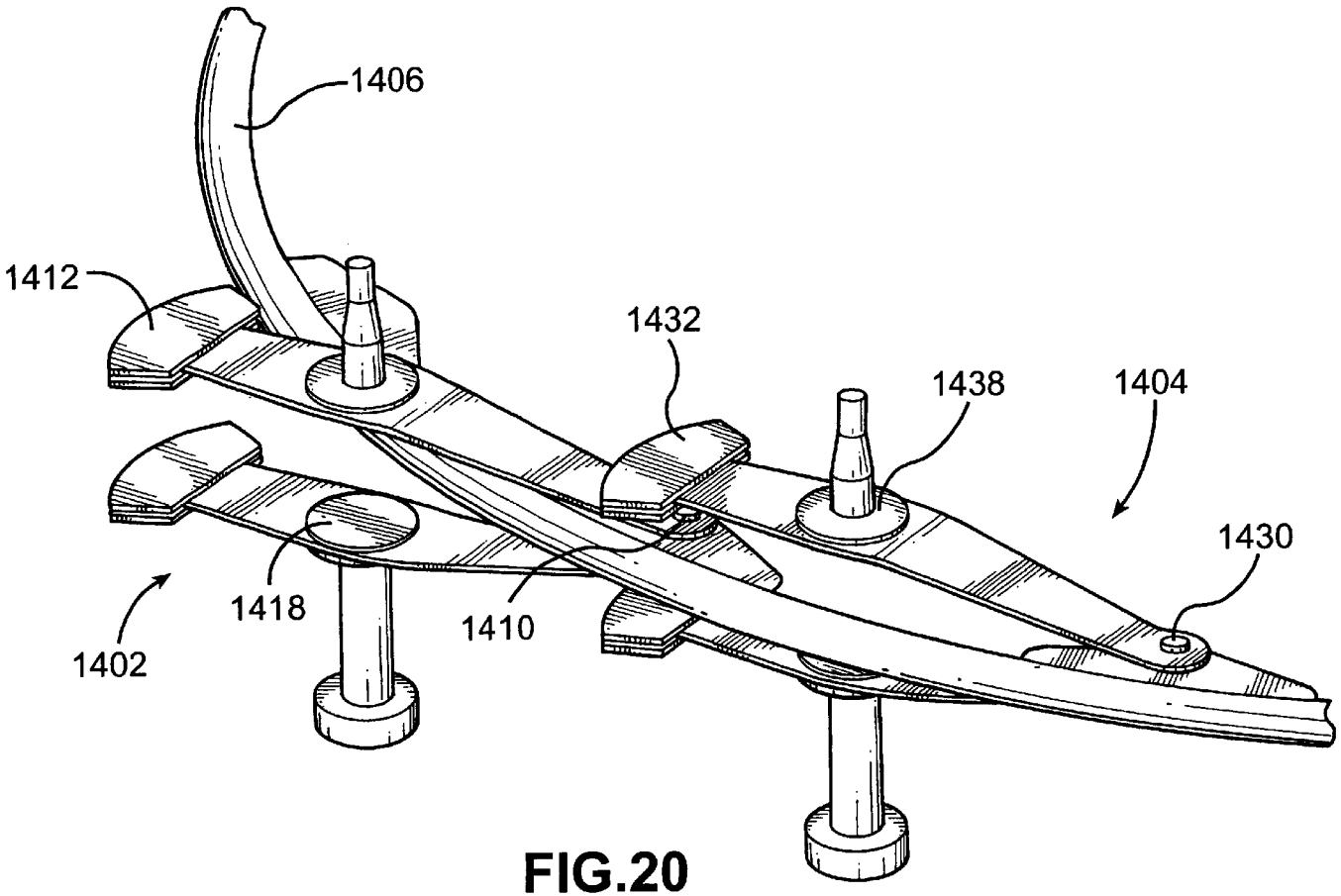
FIG. 20 is an isometric view of a preferred embodiment of a pair of arm assemblies at a fourth angular position in accordance with the present invention.
Figure 21:
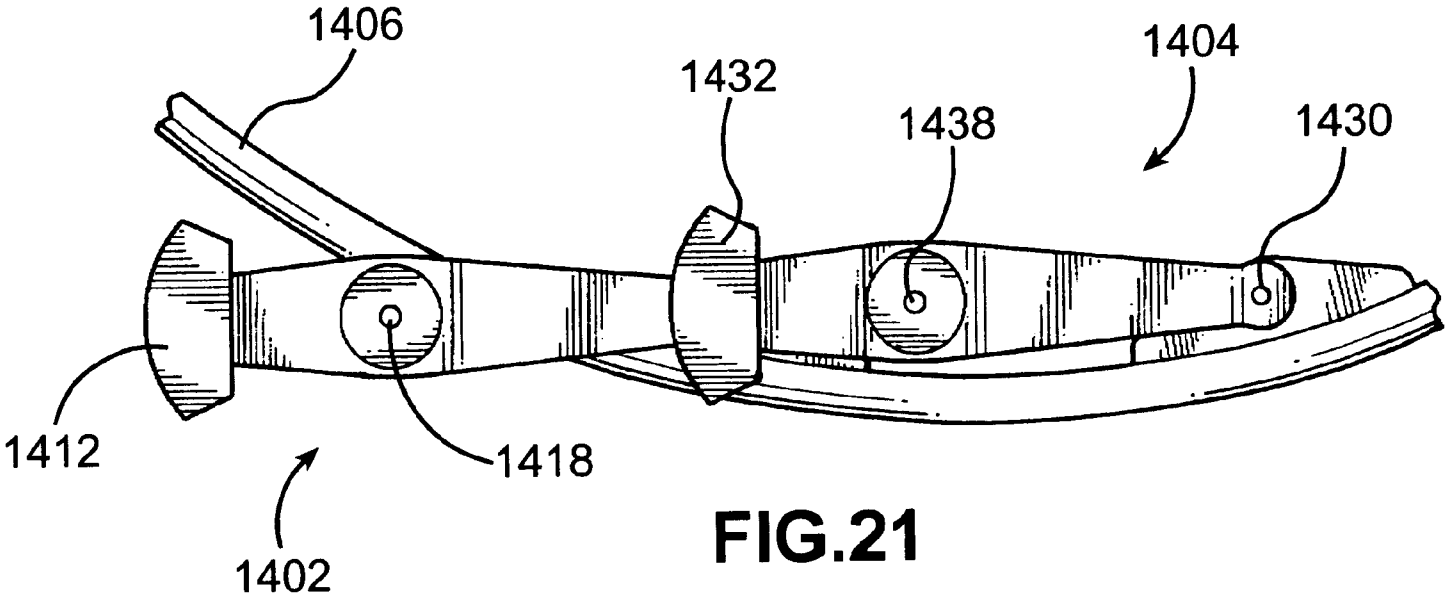
FIG. 21 is a schematic top view of a preferred embodiment of a pair of arm assemblies at a fourth angular position in accordance with the present invention.
Figure 22:
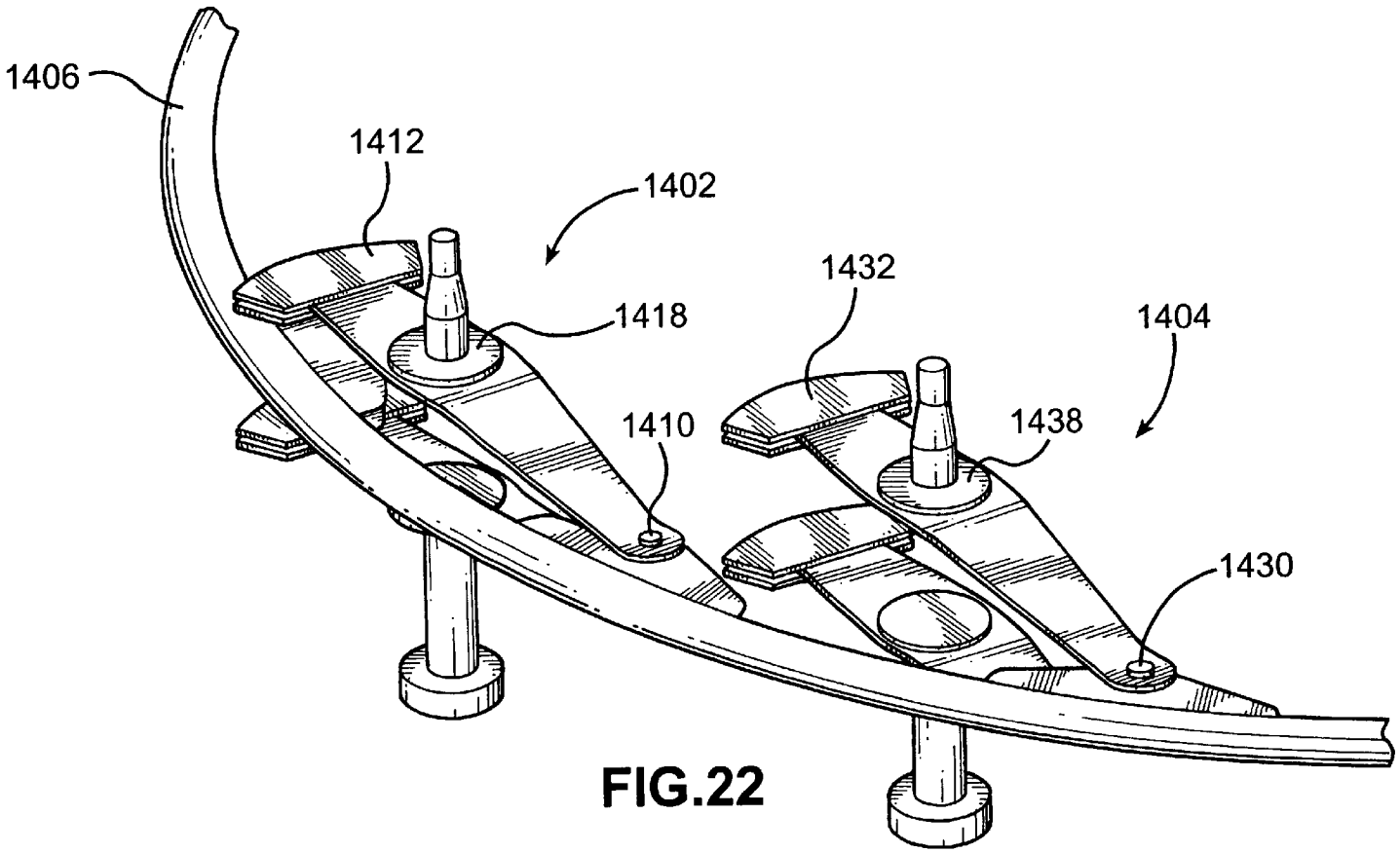
FIG. 22 is an isometric view of a preferred embodiment of a pair of arm assemblies at a fifth angular position in accordance with the present invention.
Figure 23:
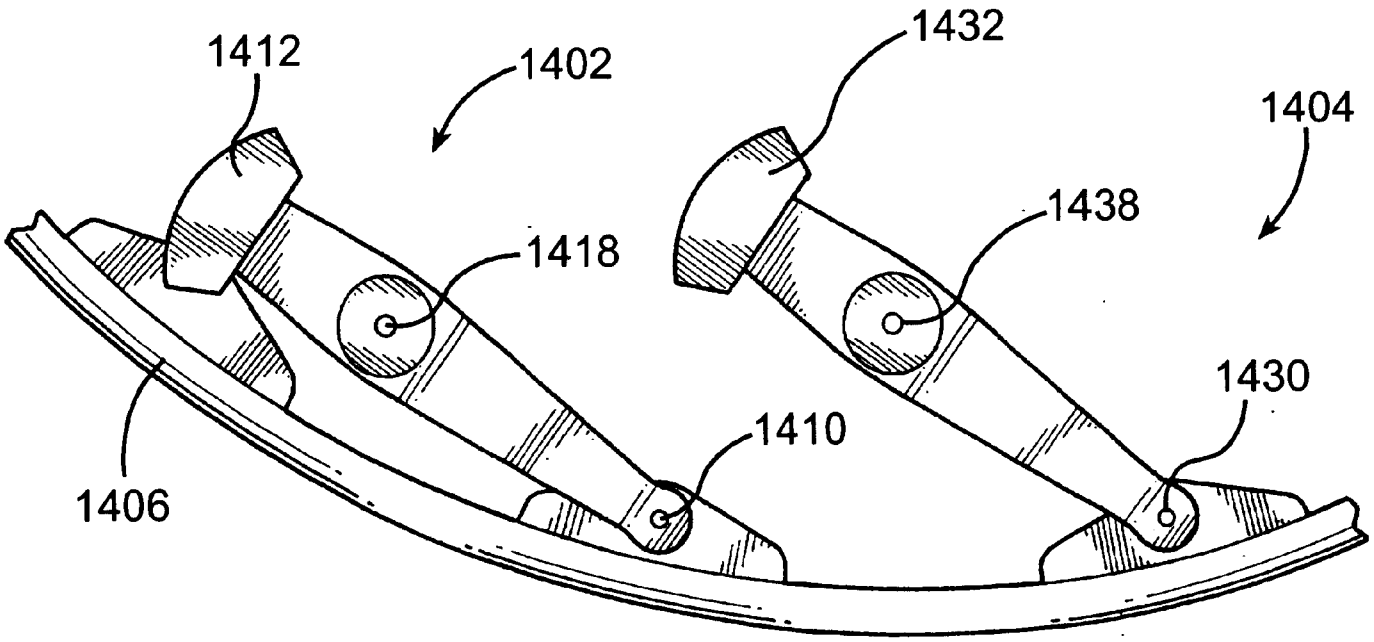
FIG. 23 is a schematic top view of a preferred embodiment of a pair of arm assemblies at a fifth angular position in accordance with the present invention.

FIGS. 18–23 show other angular positions of first arm assembly 1402 and second arm assembly 1404. FIGS. 18 and 19 show a position just before first arm assembly 1402 enters second arm assembly 1404. FIGS. 20 and 21 show a position where first arm assembly 1402 is nested inside second arm assembly 1404 and FIGS. 22 and 23 show first arm assembly 1402 moving away from second arm assembly 1404.

The various positions shown in FIGS. 14–23 demonstrate the ability of the first arm assembly 1402 and the second arm assembly 1404 to pass inside of one another. First end 1410 of first arm assembly 1402 can pass inside and through second arm assembly 1404 and first end 1430 of second swing arm assembly 1404 can pass inside and through first arm assembly 1402.

In this way, the distance between the arms S (see FIG. 17) can be reduced, thus reducing the distance C, which is the distance between first end 1410 of first arm assembly 1402 and first end 1430 of second arm assembly 1404. The distance C is also related to the distance between the provisions used to attach first and second arm assemblies to track 1406. So, by reducing the distance between arms, it is possible to reduce the distance between supports for track 1406 and increase the density of supports for track 1406. In this case, density referring to the number of supports per unit length of track. Increasing the density of supports allows the track to withstand higher loads and forces. This, in turn, allows the track to move at greater rates of gyration.

Figure 24:
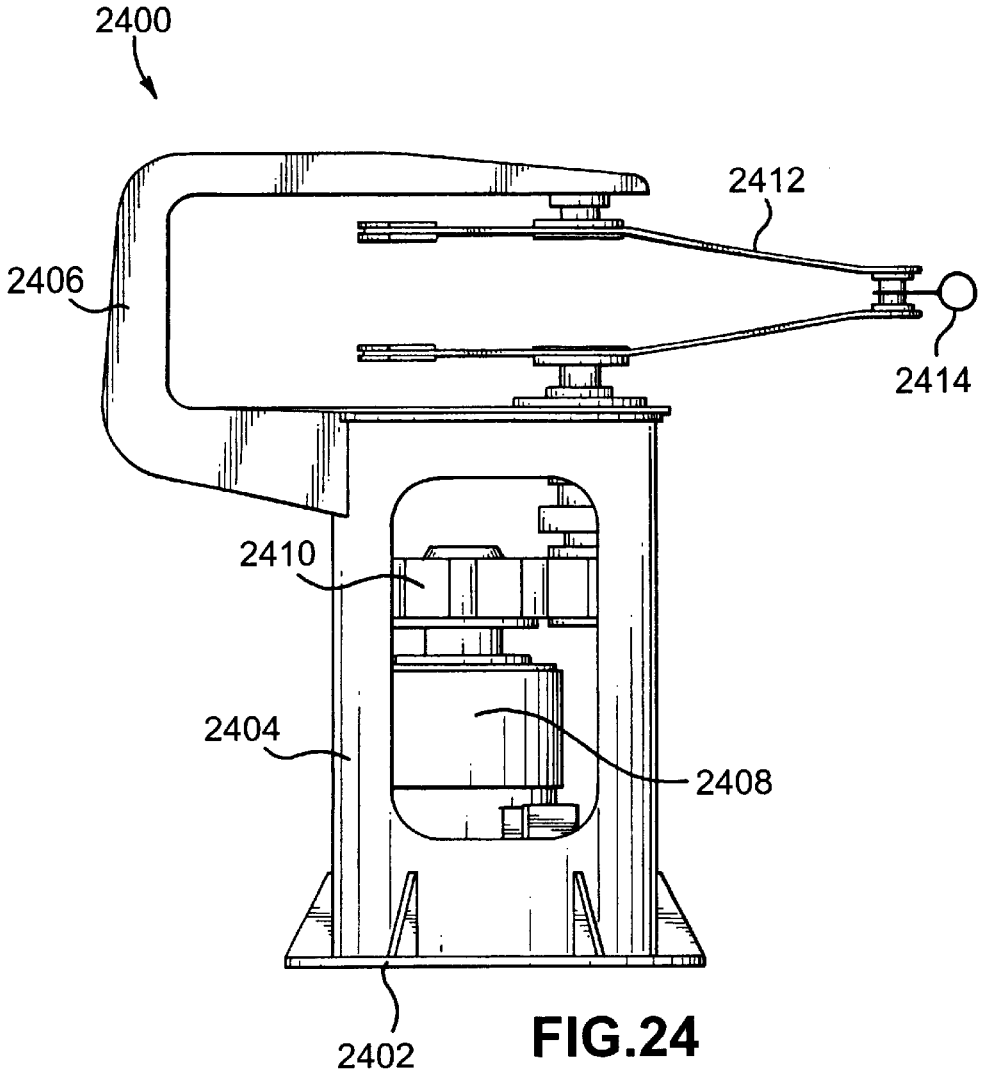
FIG. 24 is a schematic diagram of a preferred embodiment of a cantilever module in accordance with the present invention.

FIG. 24 shows a preferred embodiment of a cantilever module 2400 in accordance with the preferred embodiment of the present invention. Cantilever module 2400 includes a base 2402, base tower 2404, and a bracket 2406. Tower 2404 is disposed between base 2402 and bracket 2406. Preferably, tower 2404 includes a motor 2408 that is connected to a gear box 2410. Preferably a swing arm assembly 2412 is mounted to bracket 2406 in a manner that permits swing arm assembly 2412 to rotate with respect to bracket 2406. Preferably gear box 2410 is connected to swing arm assembly 2412 and can rotate swing arm assembly 2412. Swing arm 2412 is connected to track 2414 in a manner that permits swing arm assembly 2412 to move track 2414 in the manner described above.

Using this arrangement, motor 2408 turns an output shaft (not shown) that engages gearbox 2410. The output of motor 2408 is modified either in direction or angular rotation rate or both and the output of gearbox 2410 is used to rotate swing arm assembly 2412. Cantilever module 2400 is preferably modular and more than one module can be used to support track 2414.

Figure 25:
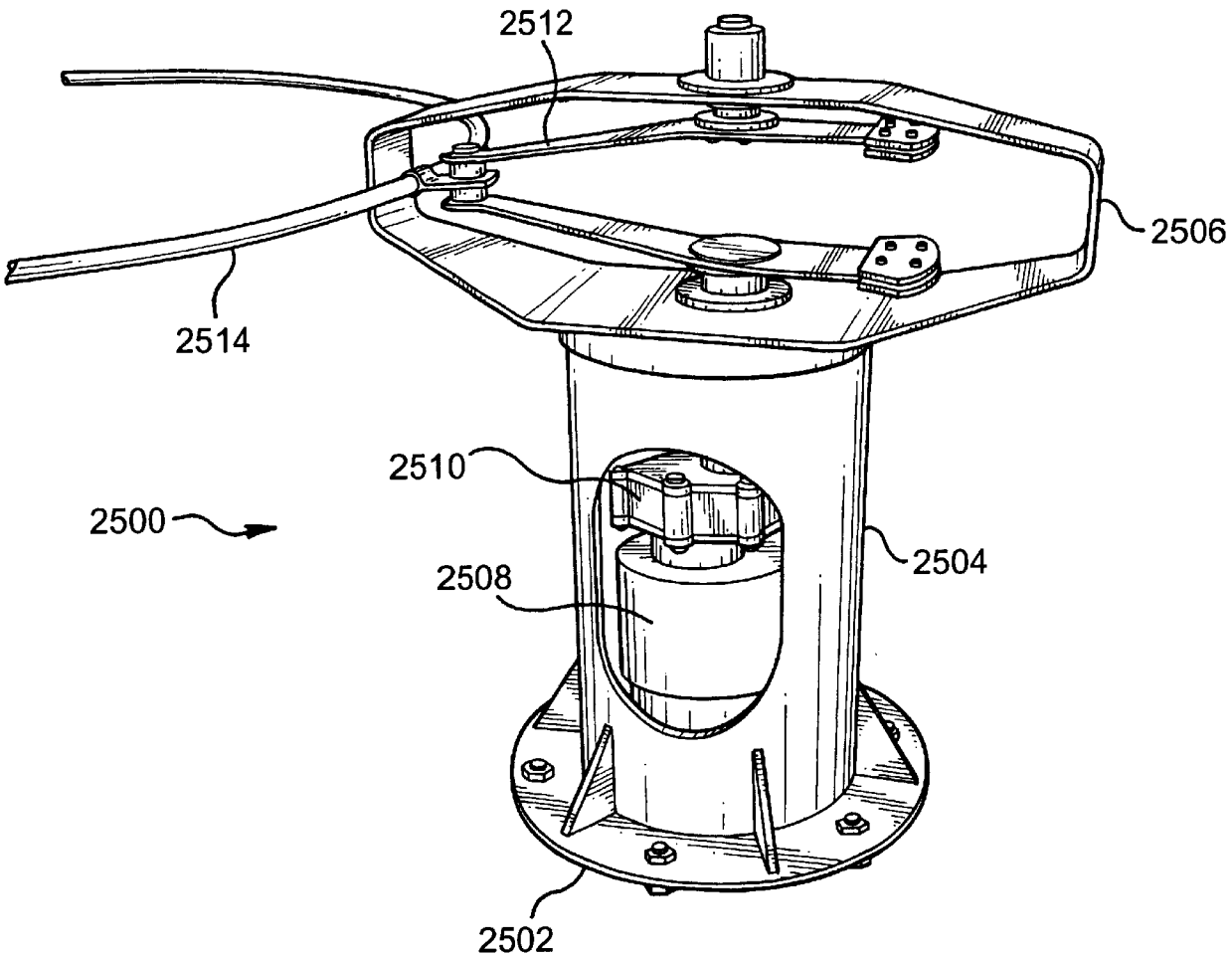
FIG. 25 is a schematic diagram of a preferred embodiment of a second module in accordance with the present invention.

FIG. 25 shows a preferred embodiment of a second module 2500 in accordance with the present invention. Second module 2500 includes a base 2502, a tower 2504 that houses a motor 2508 and a gear box 2510. Output from motor 2508 engages gearbox 2510 and the output of gearbox 2510 is used to drive the rotation of swing arm assembly 2512. Tower 2504 is connected to a bracket,2506. Bracket 2506 includes provisions that permit a swing arm assembly 2512 to rotate within bracket 2506. Swing arm assembly 2512 is also connected to a track 2514 and is connected to track 2514 in a manner that permits the track 2514 to assume a gyrating motion, as discussed above. Preferably more than one of these second modules are used to assist tract 2514 in assuming the gyrating motion.

Figure 26:
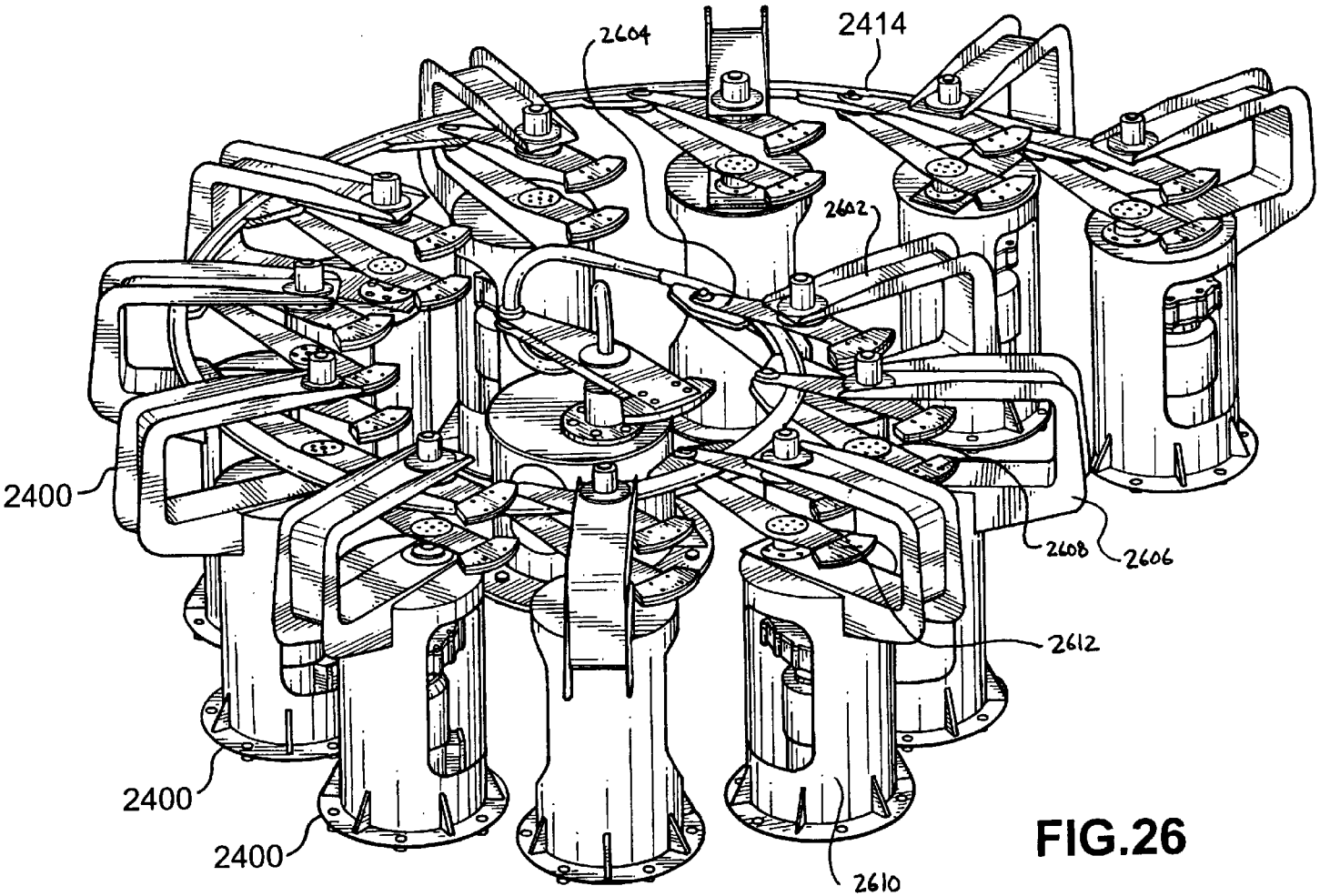
FIG. 26 is a schematic diagram of a preferred embodiment of a plurality of cantilever modules in accordance with the present invention.
Figure 27:
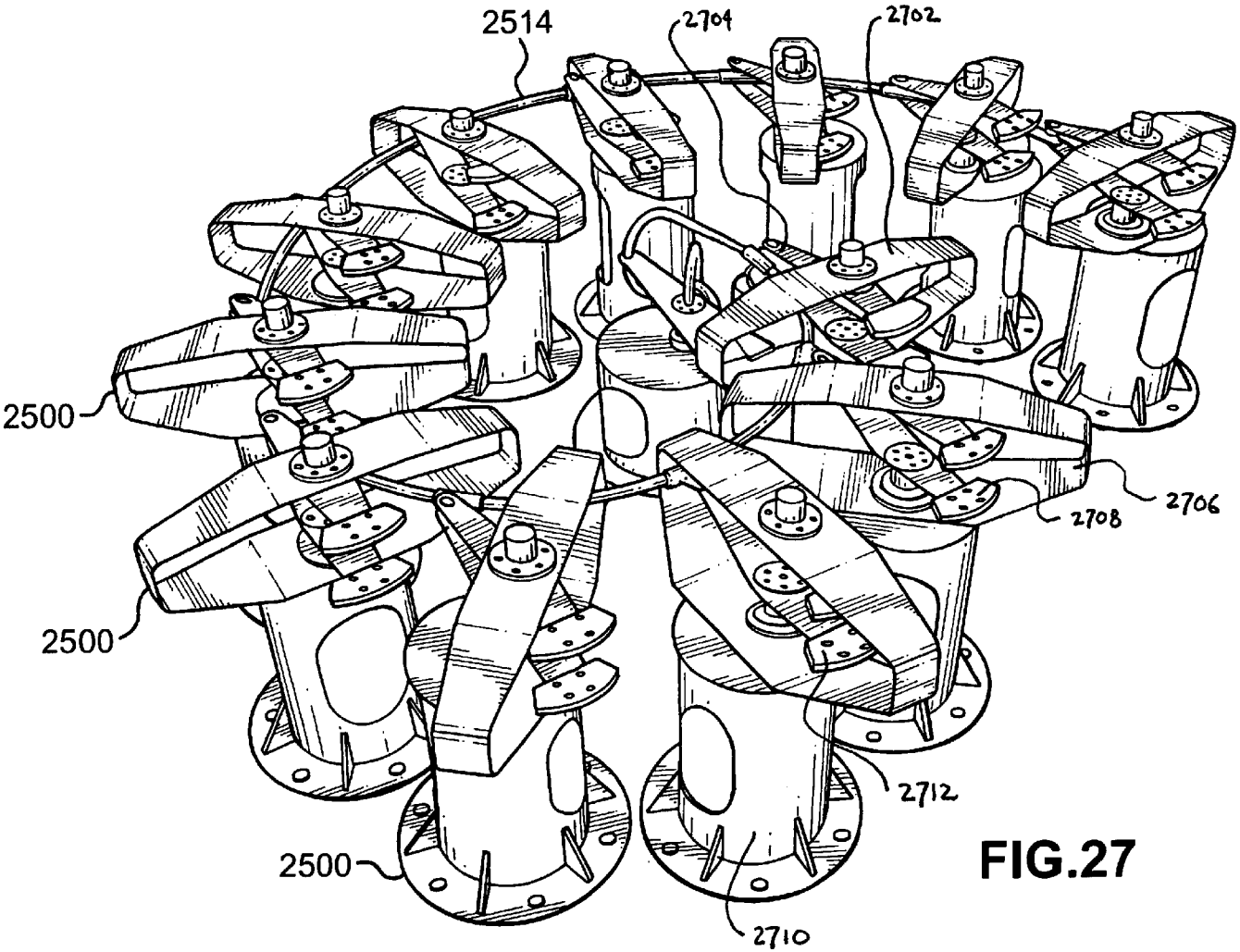
FIG. 27 is a schematic diagram of a preferred embodiment of a plurality of second modules in accordance with the present invention.

FIG. 26 shows an embodiment where a plurality of cantilever modules are used to retain and gyrate track 2414 and FIG. 27 shows an embodiment where a plurality of second modules are used to retain and gyrate track 2514.

Referring to FIGS. 26 and 27, the preferred method of laying out the various modules is as follows. A first module 2602 or 2702 is placed in a location that facilitates the swing arm 2604 and 2704, respectively, associated with the first module 2602 and 2702 to connect with track 2414 and 2515, respectively. After the first module 2602 and 2702 is placed, the second module 2606 and 2706 is placed so that second arm 2608 and 2708, respectively, associated with the second module 2606 and 2706 can both connect to track 2414 and 2514 and the second arm 2608 and 2708 can assume an orientation parallel with first arm 2604 and 2704. The third module 2610 and 2710 is also placed so that third arm 2612 and 2712 can connect to track 2414 and 2514 and assume an orientation parallel to both the first and second arms. This process continues until all of the modules are placed in convenient locations where all of the arms can connect to track 2414 and 2514 and all of the arms can be parallel with one another.

The various modules use their associated motors and gearboxes to deliver a rotary drive to their associated swing arm assemblies. Preferably, the motors are coordinated so that track 2414 or track 2514 moves in a gyrating manner, as discussed above. In this way, as projectiles are fed into track 2414 or 2514, the projectiles move along the track and are launched by the apparatus.

Figure 28:
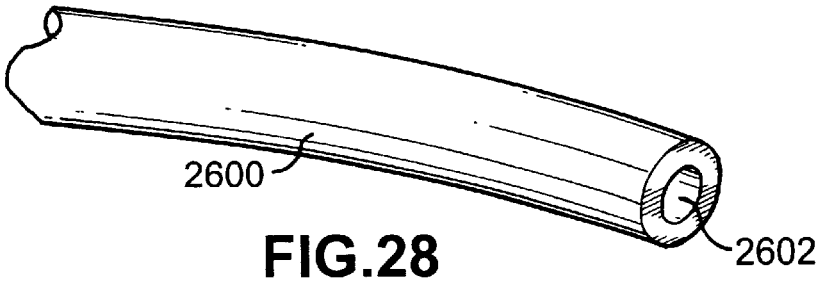
FIG. 28 is an isometric diagram of a preferred embodiment of a tube in accordance with the present invention.
Figure 29:
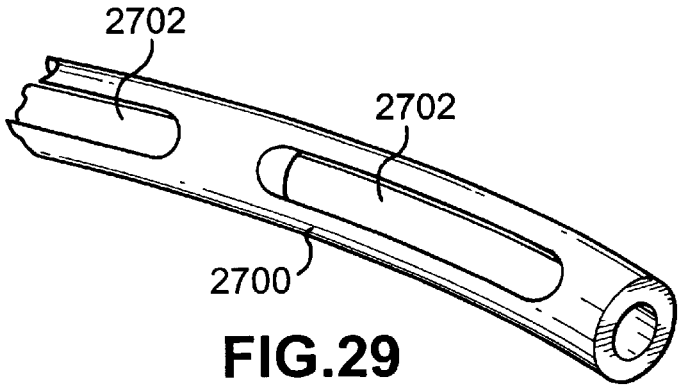
FIG. 29 is an isometric diagram of a preferred embodiment of a slotted tube in accordance with the present invention.
Figure 30:
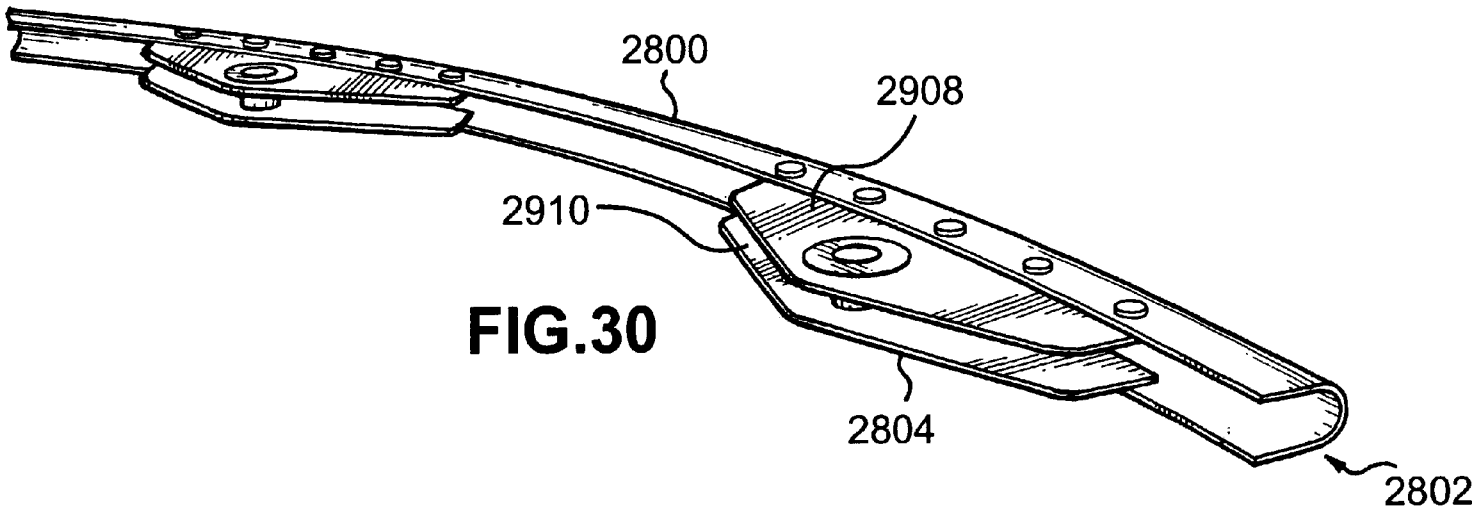
FIG. 30 is an isometric diagram of a preferred embodiment of a channel in accordance with the present invention.

FIGS. 28–30 show various designs of track 2414 or track 2514. As shown in FIG. 28, the track 2600 can be an enclosed tube with projectiles moving through the hollow center 2602 of tube 2600. The track can also be a slotted tube 2700, as shown in FIG. 29. Slotted tube 2700 can include slots 2702 that permit the escape of air, thus reducing air drag and resistance on the projectile. Preferably, slots 2702 are formed on the inner curve of the track. In other words, slots 2702 are disposed in a region away from the path of contact between the projectile and the track.

FIG. 30 shows another embodiment of a track 2800. Track 2800 is designed as an open channel 2802. Preferably, open channel 2802 resembles a U-shaped channel. Track 2800 includes provisions to hold and move track 2800. Preferably, supports 2804 are used to hold track 2800. Preferably, support 2804 includes two flanges, an upper flange 2908 and a lower flange 2910.

Figure 31:
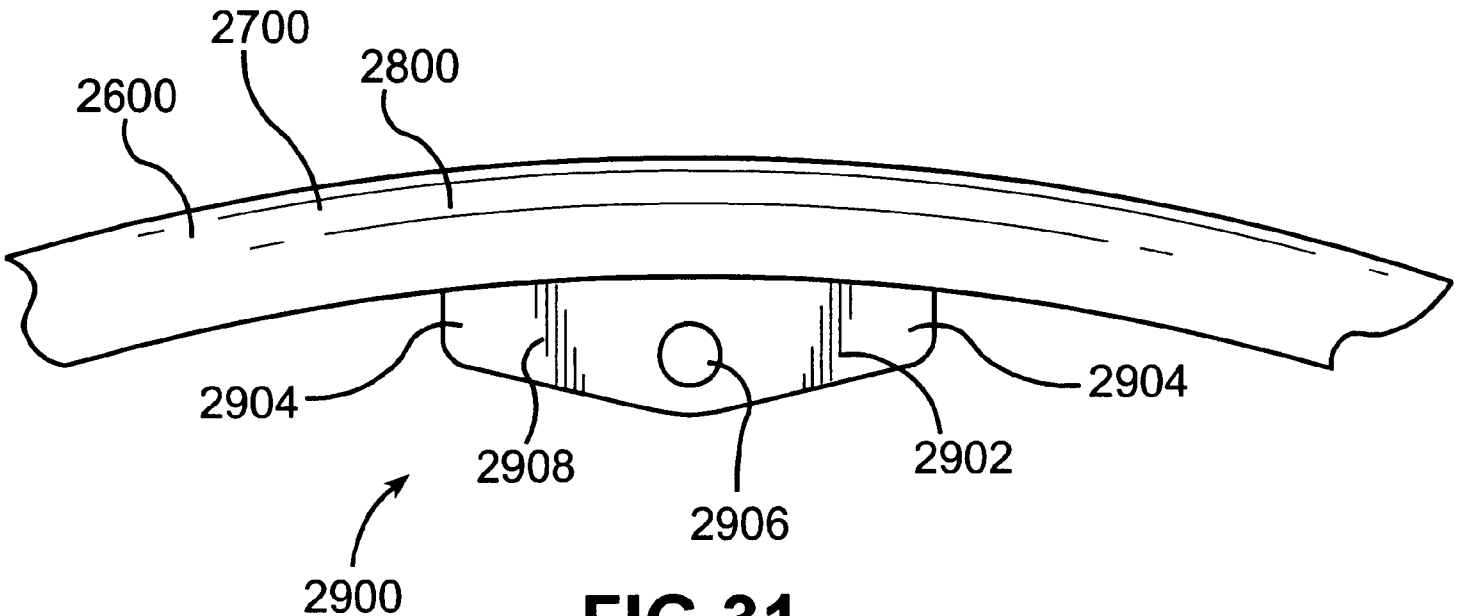
FIG. 31 is a cross-sectional view of a preferred embodiment of a clamp in accordance with the present invention.

FIG. 31 shows a preferred arrangement to associate a track, which could be either tube 2600, slotted tube 2700, or channel 2800 (see FIG. 30) with a swing arm assembly. Preferably, clamp or support 2900 is used to hold tube 2600 or 2700. FIGS. 8A and 8B show an embodiment of a clamp 372 (see FIG. 8B). In an exemplary embodiment of the present invention, clamp or support 2900 is formed as a flange 2908 extending from the track. Preferably, clamp or support 2900 is tapered and includes a thicker central portion 2902 and thinner end portions 2904. In the context of this feature, the terms "thicker" and "thinner" can refer to thickness in the local radial direction (as shown in FIG. 31) or thickness in the axial direction. This is done to reduce parasitic mass. One or more flanges 2908 can be used. In an exemplary embodiment, shown in FIG. 30, two flanges, an upper flange 2908 and a lower flange 2910 are used.

Clamp or support 2900 can also include suitable provisions to associate with a swing arm (not shown in FIG. 31). In a preferred embodiment, those provisions could be an aperture 2906 disposed on the thicker central portion 2902. The aperture 2906 preferably is configured to receive a suitable coupler 318 (see FIG. 8A).

The track can also be designed as a channel 2800, as shown in FIG. 30. The channel 2800 can assume may different shapes, however, a U-shape, as shown in cross-section 2802 is preferred. Channel 2800 also preferably includes provisions that permit a swing arm assembly from retaining and holding channel 2800. Preferably, these provisions include at least one flange 2804 that is attached to channel 2800 and also provides a convenient mounting point for the swing arm assembly.

Figure 32:
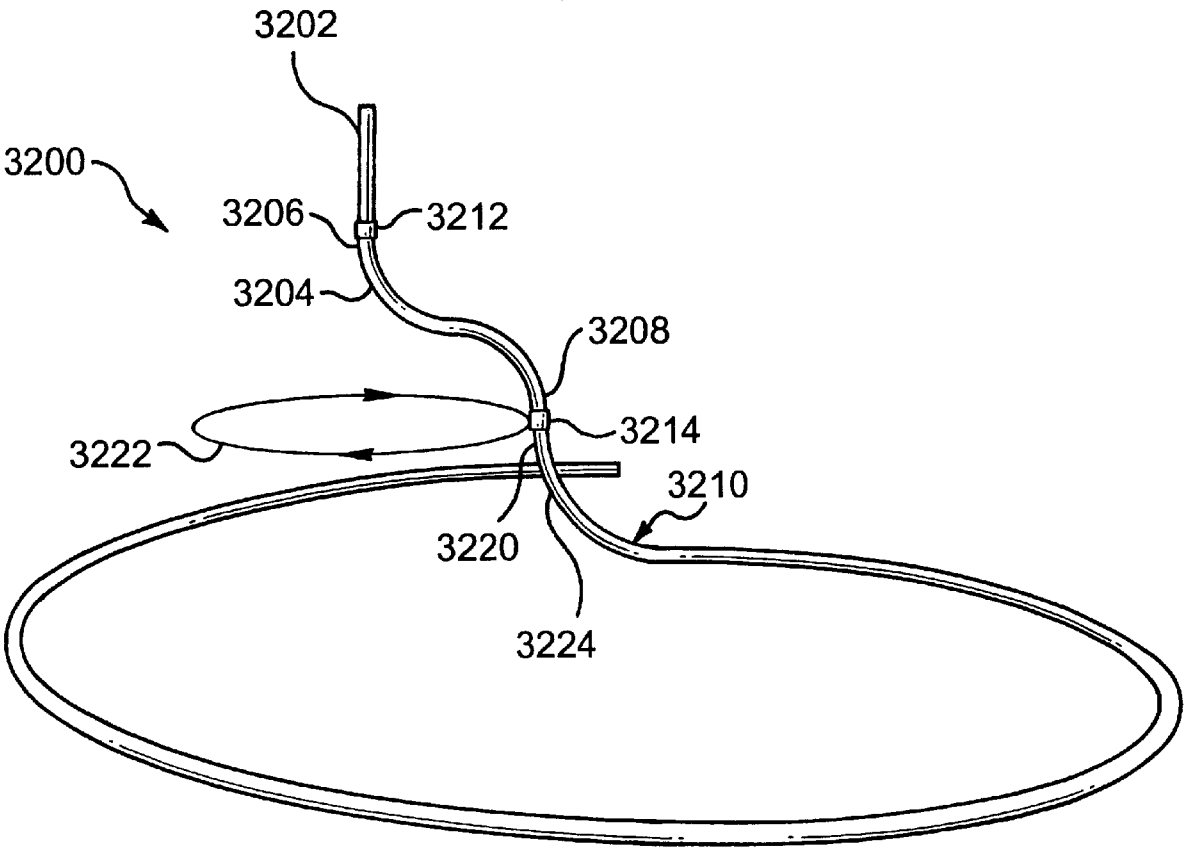
FIG. 32 is a schematic diagram of a preferred embodiment of a feed mechanism in accordance with the present invention.

In order to load the apparatus with projectiles, a feed system is preferably used. Referring to FIG. 32, which shows a schematic diagram of a preferred feed mechanism 3200, the feed mechanism 3200 preferably includes a feed inlet 3202 and a rotating feed tube 3204. Rotating feed tube 3204 has a first end 3206 that is in flow communication with feed inlet 3202 and serves as the inlet and accepts projectiles or masses from feed inlet 3202. Second end 3208 is in flow communication with track 3210 and serves as an outlet, with projectiles or masses exiting second end 3208 and entering track 3210.

Preferably, feed inlet 3202 is stationary relative to track 3210. To accommodate the relative motion between stationary feed inlet 3202 and moving track 3210, a first pivot or rotating collar 3212 is provided between feed inlet 3202 and first end 3206 of rotating feed tube 3204 and a second pivot or rotating collar 3214 is provided between the second end 3208 of rotating feed tube 3204 and track 3210.

Because of the gyrating motion of track 3210, first end 3220 of track 3210 moves in a simple circular path 3222. Preferably, feed inlet 3202 is oriented vertically and projectiles are loaded into rotating feed tube 3204 from feed inlet 3202. In some embodiments, the projectiles are dropped into rotating feed tube 3204 and in other embodiments, the projectiles are punched into feed tube 3204 by an appropriate actuator (not shown). The actuator is used to insure proper delivery of the projectile into feed tube 3204 and to insure proper progression of the projectile from feed tube 3204 into track 3210.

Preferably, rotating feed tube 3204 rotates about feed inlet 3202. This rotation can be accomplished by a drive system or rotating feed tube 3204 can be rotated passively by the gyrating motion of track 3210.

Preferably, an inlet region 3224, proximate the first end 3220 of track 3210, is bent towards rotating feed tube 3204. Inlet region 3224 can also be strengthened to accommodate the additional stresses and forces imposed on it. In an exemplary embodiment of the present invention, inlet region 3224 is strengthened by a thicker wall thickness than other regions of track 3210.

As projectiles are dropped into rotating feed tube 3204, their motion transitions from a vertical motion to a rotating motion until they enter track 3210, after which, the projectiles acquire a gyrating motion and are eventually launched from track 3210.

Figure 33:
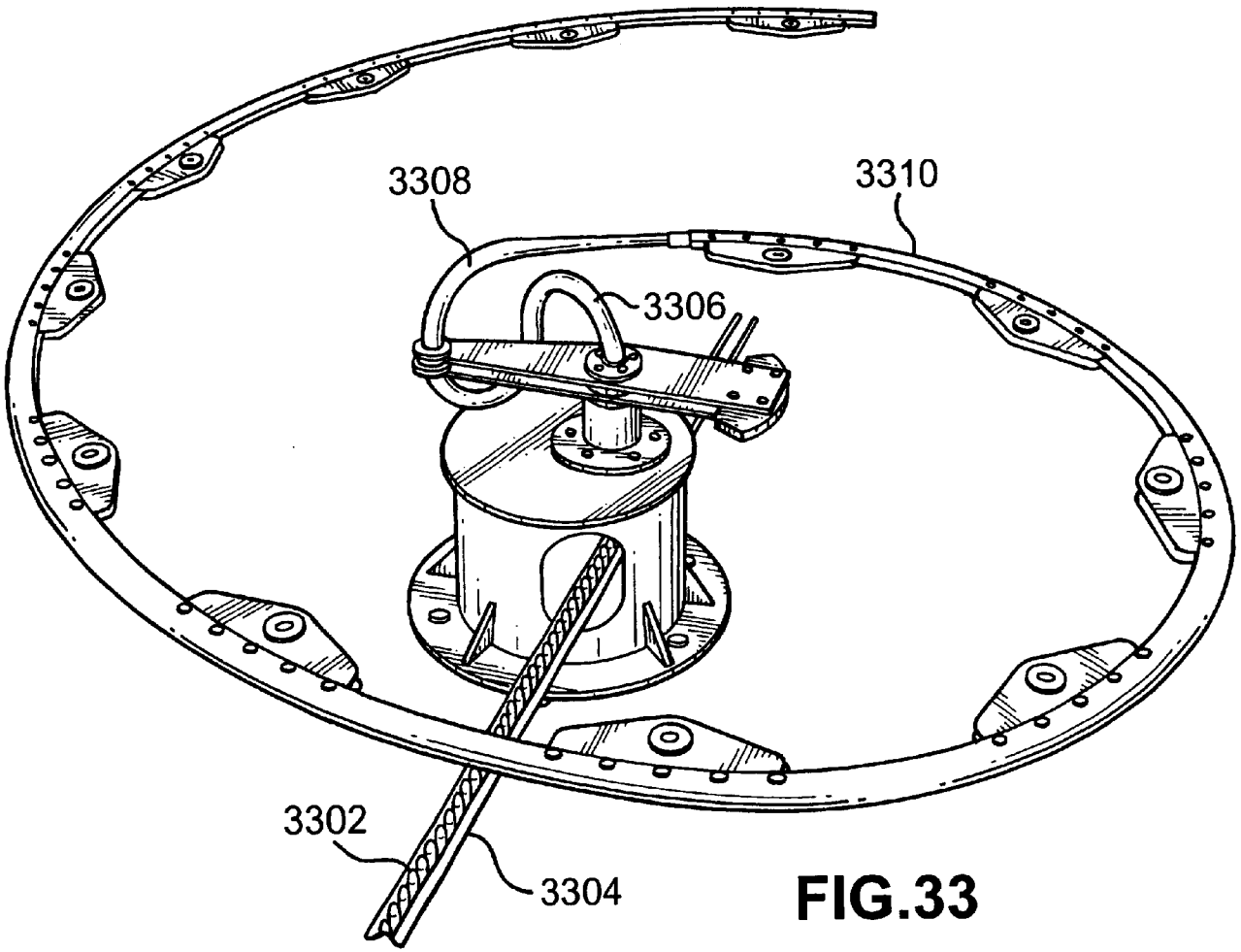
FIG. 33 is an isometric view of a preferred embodiment of a feed mechanism in accordance with the present invention.

FIG. 33 shows an alternative embodiment of a feed mechanism 3300 according to the present invention. In this embodiment, projectiles are fed from a conveyor system 3304 towards an actuator (see FIG. 34). The actuator moves the projectile 3302 upwards into rotating feed tube 3306. The projectile 3302 eventually makes its way into transition tube 3308, which is designed to move with track 3310 and is in flow communication with both rotating tube 3306 and track 3310. The projectile exits transition tube 3308 and enters track 3310 where the projectile is gyrated and is eventually launched by track 3310.

Figure 34:
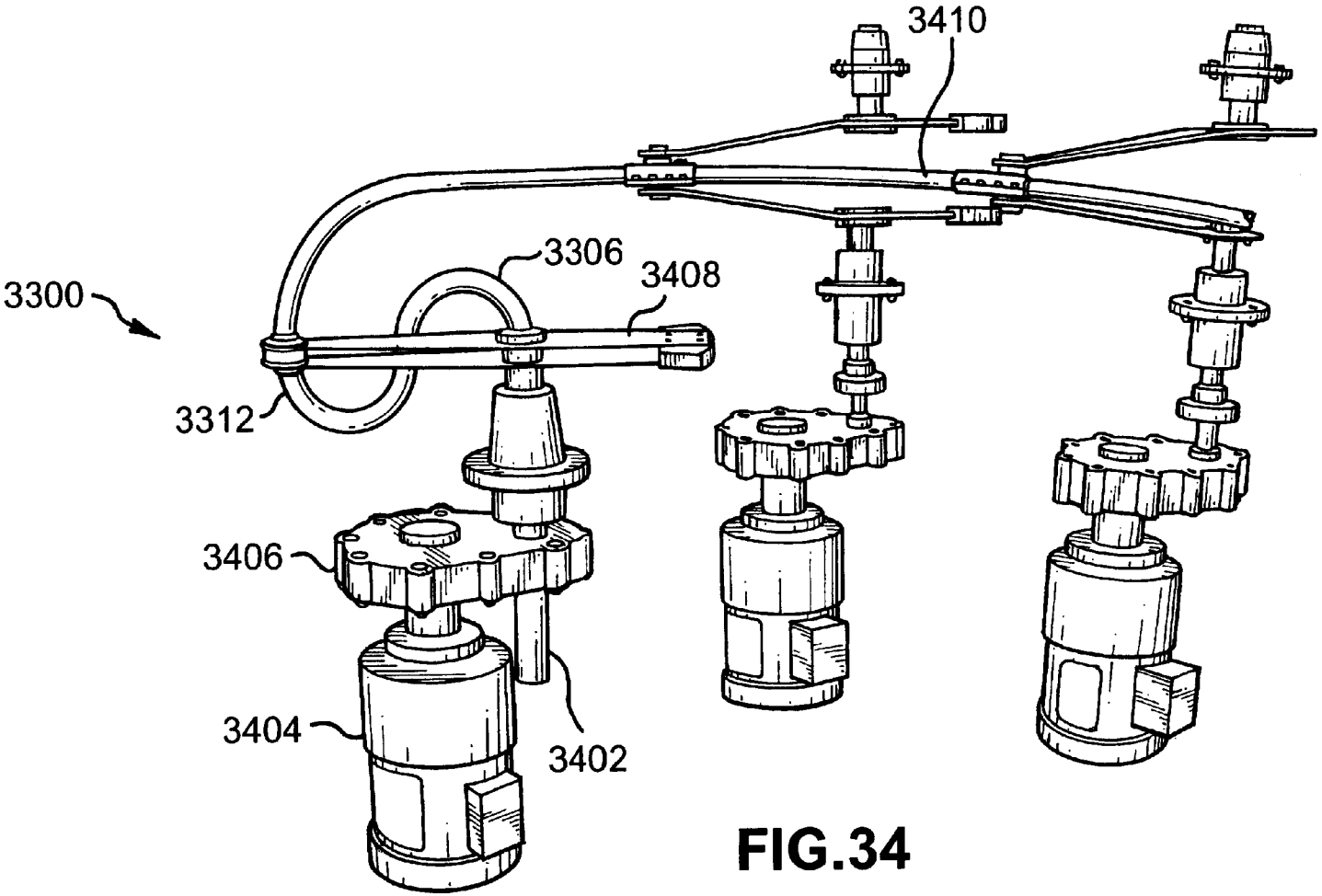
FIG. 34 is an enlarged isometric view of a preferred embodiment of a feed mechanism in accordance with the present invention.

FIG. 34 shows an enlarged isometric view of a preferred embodiment of a drive system for feed mechanism 3300. Feed mechanism preferably includes an actuator 3402 that is designed to move projectiles towards rotating feed tube 3306. Feed mechanism 3300 also includes a motor 3404 and a gear box 3406. Power from motor 3404 is sent to gear box 3406 which is carefully designed to select the appropriate gear ratio, output from gear box 3406 turns drive link 3408 at a predetermined rotational speed. Preferably, this speed is selected so that second end 3312 of rotating feed tube 3306 corresponds to the gyrating motion of track 3410.

Figure 35:
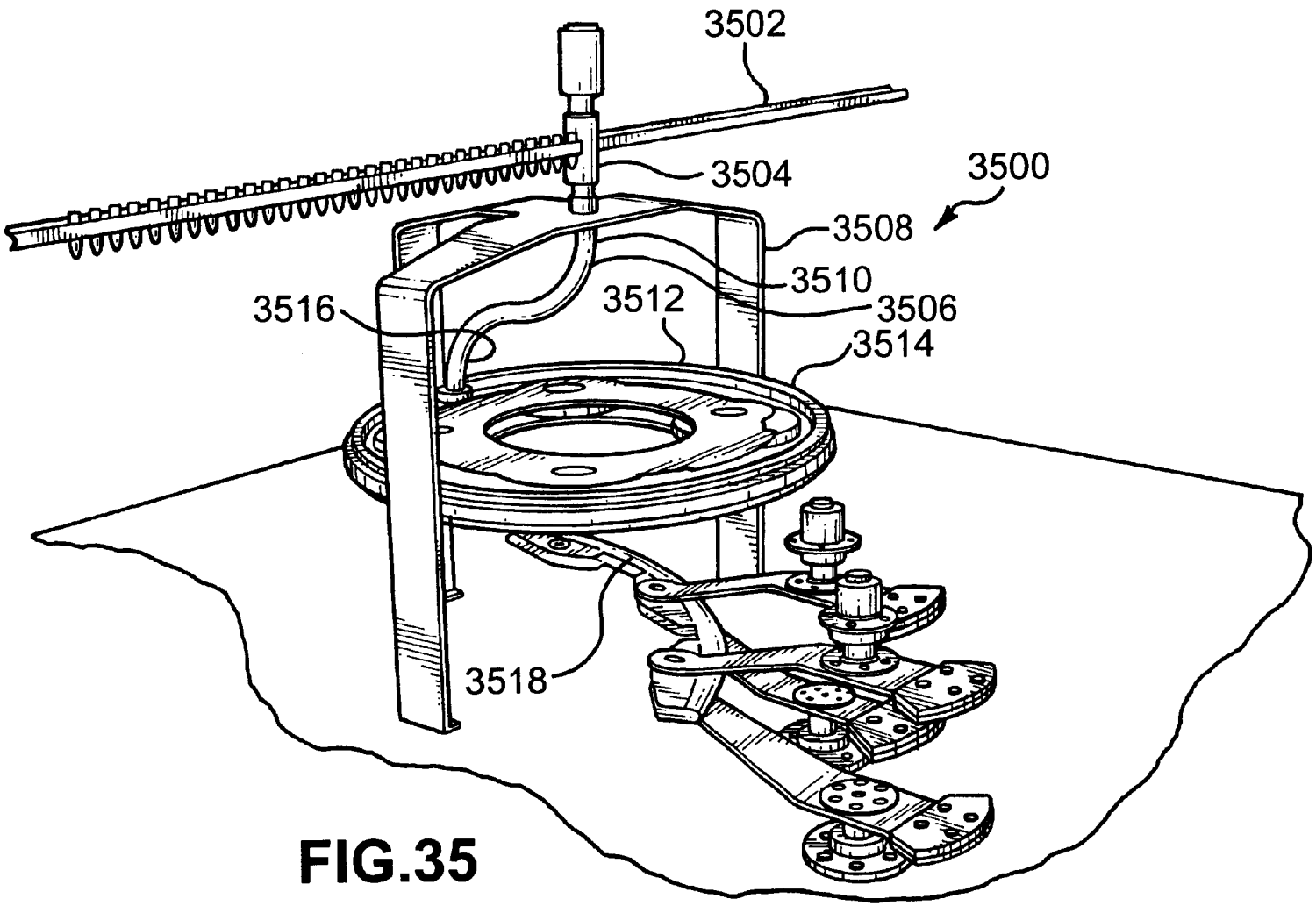
FIG. 35 is an isometric view of a preferred embodiment of an overhead feed mechanism in accordance with the present invention.

FIG. 35 shows another embodiment of a feed mechanism 3500. In this embodiment, projectile conveyor 3502 is disposed above inlet tube 3504 and above rotating feed tube 3506. Preferably, a stand 3508 is used to restrain the motion of inlet tube 3504 and the first end 3510 of rotating feed tube 3506. A rotating bearing 3512 rotates within an internal bearing race 3514 and drives the rotation of the second end 3516 of rotating feed tube 3506. Preferably, suitable rotating collars (not shown) are provided at both ends of rotating feed tube 3506 to permit rotating feed tube 3506 to rotate. Similar to the other embodiments of feed mechanisms, second end 3516 is preferably in flow communication with an inlet end of track 3518.

Figure 36:
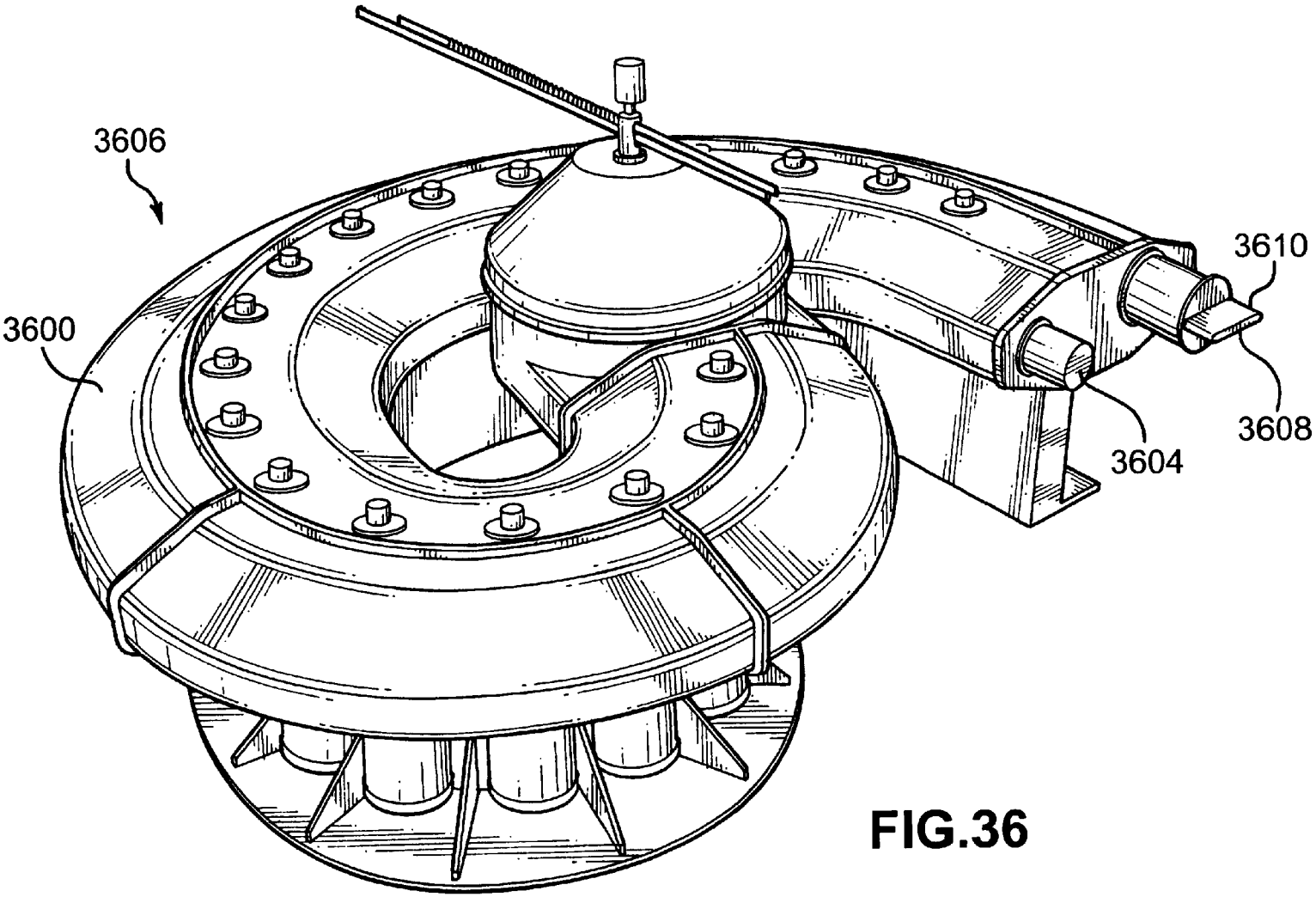
FIG. 36 is an isometric view of a preferred embodiment of an enclosure in accordance with the present invention.
Figure 37:
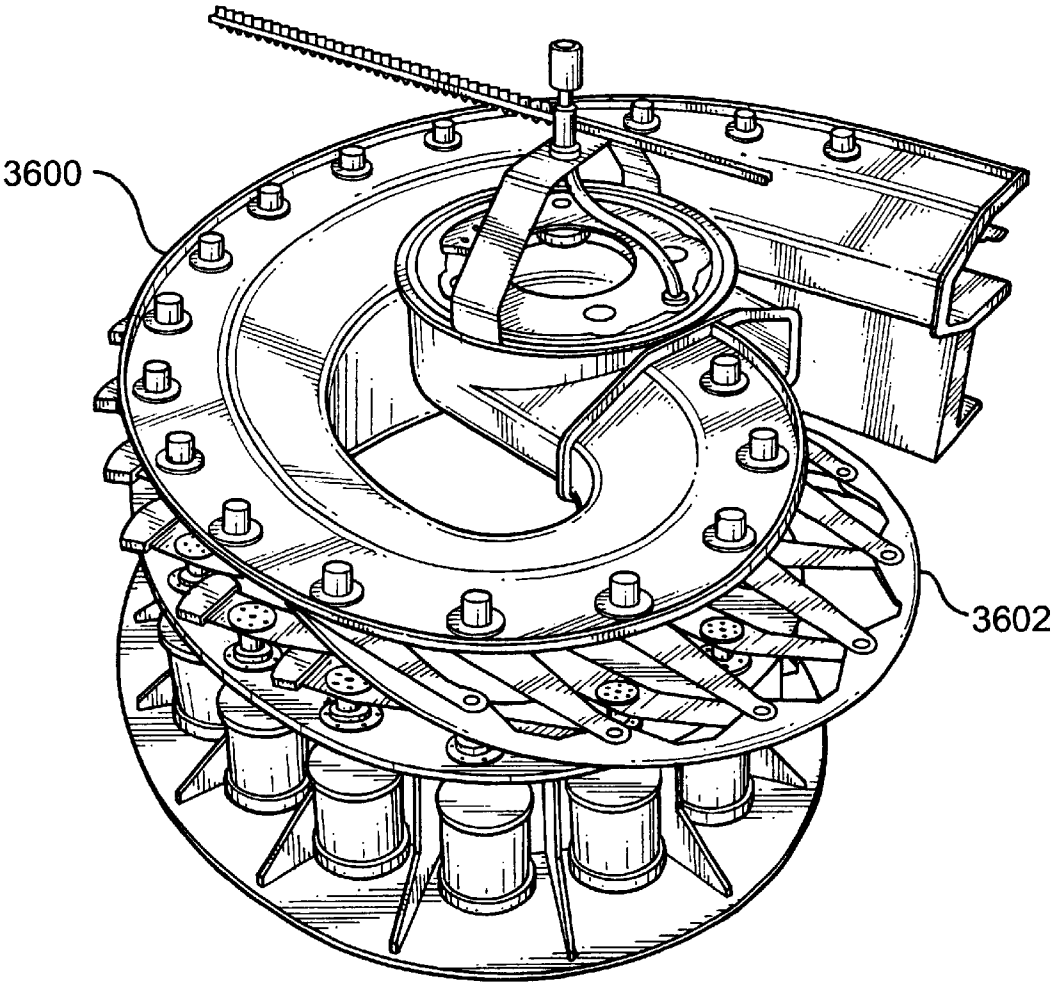
FIG. 37 is an isometric cutaway view of a preferred embodiment of an enclosure in accordance with the present invention.

FIGS. 36 and 37 show another embodiment of the present invention. FIG. 36 is an isometric view of a preferred embodiment of the present invention and FIG. 37 is an isometric view with a portion of an enclosure removed. In this embodiment, a housing 3600 encloses spiral track 3602 (see FIG. 37) a vacuum device 3604 is used in conjunction with housing 3600 to remove air from inside housing 3600. This is done to reduce air drag on spiral tack 3602 and all of the other moving components of the mass moving apparatus. A vacuum environment inside the enclosure is desirable since the swing speed with which the swing arm assemblies swing the tube can be supersonic, atmospheric drag can impose considerable forces on the rotating members of the apparatus.

Preferably, vacuum device 3604 is a fan, blower, pump or vacuum pump and causes a pressure difference between the interior of housing 3600 and ambient atmospheric conditions 3606. Preferably, vacuum device 3604 acts to remove air and subsequently air pressure from inside housing 3600.

Enclosure 3600 also includes an outlet orifice 3608. Projectiles are launched out of orifice 3608. It is desirable to maintain the pressure difference at orifice 3608. An attractive method to assist in maintaining the pressure difference is to provide a "Windowless Interface" between the vacuum and the outside air by using a wall-stabilized discharge inside orifice 3608. There is scientific literature (theory and experiments) in which such a Plasma Discharge acts as such a "Windowless Interface" (experiments show even as good as~10 torr on the vacuum side). Due to its high temperature, the plasma discharge has enough pressure to hold out the atmosphere, but has only a very small particle number density compatible with the vacuum. Solid Projectiles could pass through the discharge window without encountering any solid mass. Preferably, in order to assist in maintaining the pressure difference between the interior portion of housing 3600 and ambient atmospheric conditions, a plasma window 3610 is established on orifice 3608.

Details of plasma gates can be found in A. I. Hershcovitch et al, "The Plasma Window: A Windowless High Pressure-Vacuum Interface for Various Accelerator Applications," Proceedings of the 1999 Particle Accelerator Conference, N. York, 1999, which is hereby incorporated by reference in its entirety.

Figure 38:
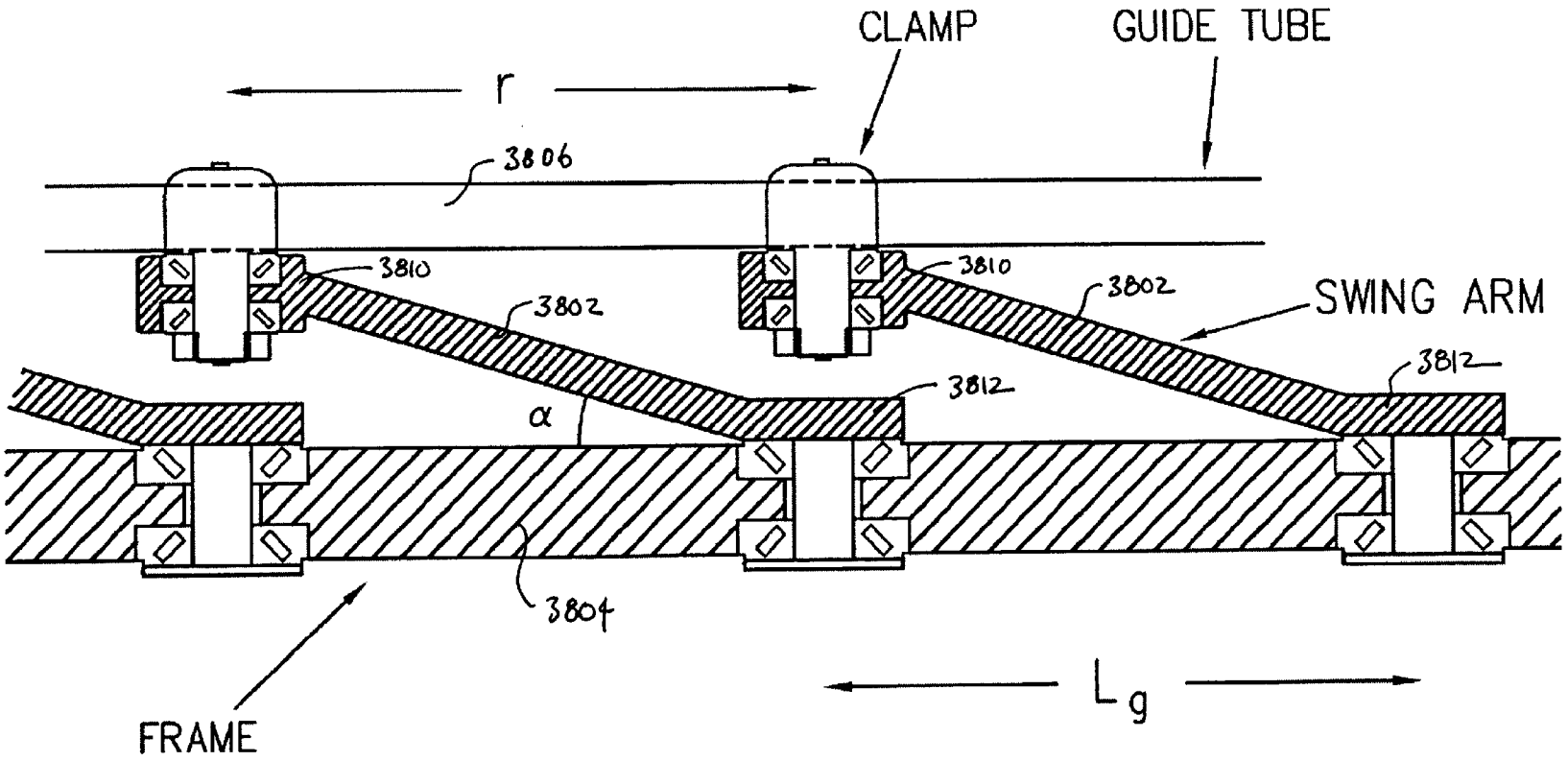
FIG. 38 is a cross-sectional side view of a preferred embodiment of an arrangement of swing arms in accordance with the present invention.
Figure 39:
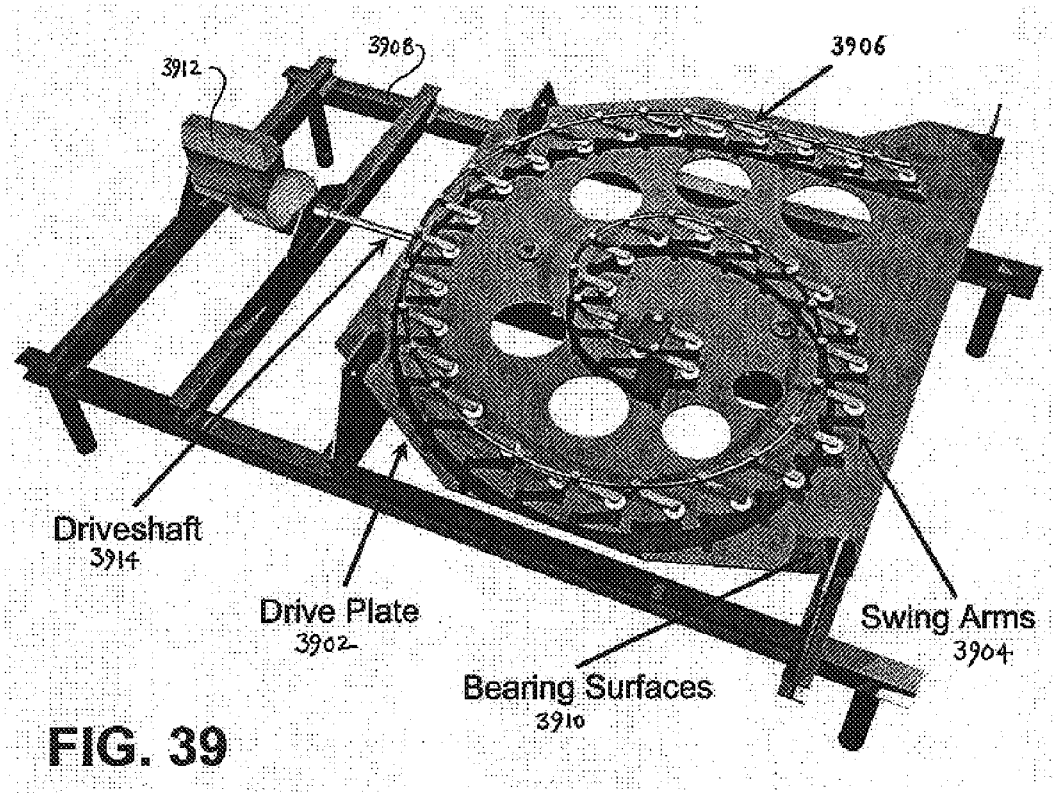
FIG. 39 is an isometric view of a preferred embodiment of a drive plate embodiment in accordance with the present invention.
Figure 40:
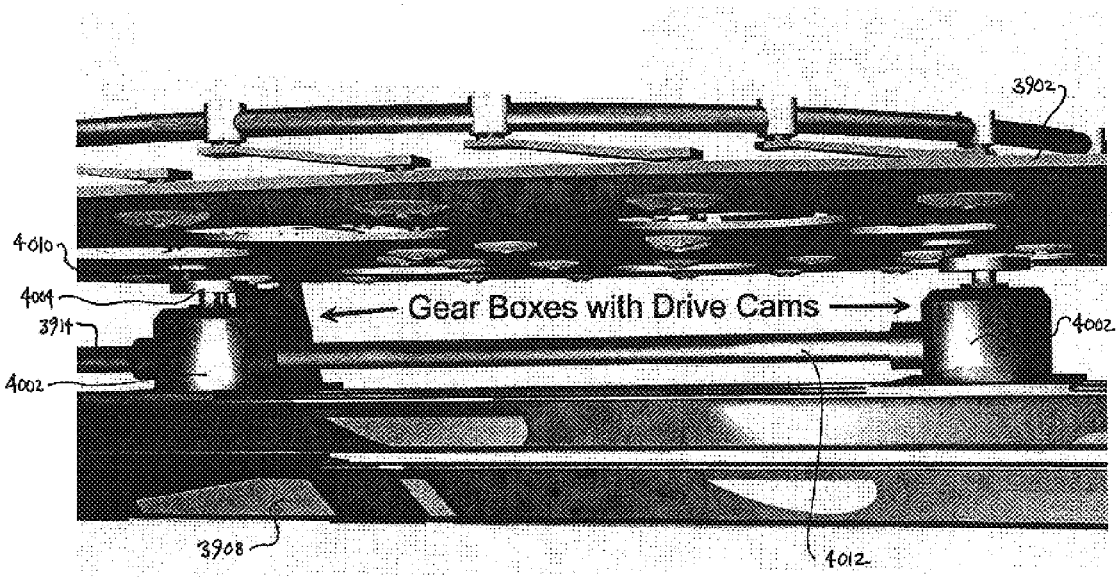
FIG. 40 is a side view of a preferred embodiment of a drive plate embodiment in accordance with the present invention.

For some applications it may be desirable to use one or a few large motors to power the rotational motion of the swing arms. A preferred embodiment is shown in FIGS. 38–40. FIG. 38 shows a side view of a preferred embodiment of an arrangement of swing arms 3802. Swing arms 3802 include a first end 3810 and a second end 3812. First ends 3810 of swing arms 3802 are used to hold a track 3806 and second ends 3812 of swing arms 3802 are attached to a common frame 3804.

Motion of frame 3804 can be used to induce motion of swing arms 3802, which can, in turn, induce motion of track 3806. Motion of frame 3804 can be either circular or oscillating linear motion.

FIG. 39 shows an isometric view of a preferred embodiment of a drive plate embodiment. In this embodiment, a drive plate 3902 is used to retain a series of swing arms 3904, and swing arms 3904 support a spiral track 3906. Preferably, swing arm counterweights are either reduced or removed. Drive plate 3902, also referred to as a frame, is associated with a mount 3908 by one or more bearing surfaces 3910. Bearing surfaces 3910 permit drive plate 3902 to move relative to mount 3908. Bearing surfaces 3910 can include magnetic levitation, air bearings, mechanical cams, mechanical linkages, elastomeric bearings or any other bearing that would permit relative motion between drive plate 3902 and mount 3908.

Drive plate 3902 is preferably driven by a motor 3912. Preferably, motor 3912 is also mounted on mount 3908 and preferably, motor 3912 is connected to drive plate 3902 by a driveshaft 3914. Motor 3912 includes a rotary shaft output. In order to convert this rotational motion to circular motion, one or more gear boxes 4002 (see FIG. 40) are used.

Figure 41:
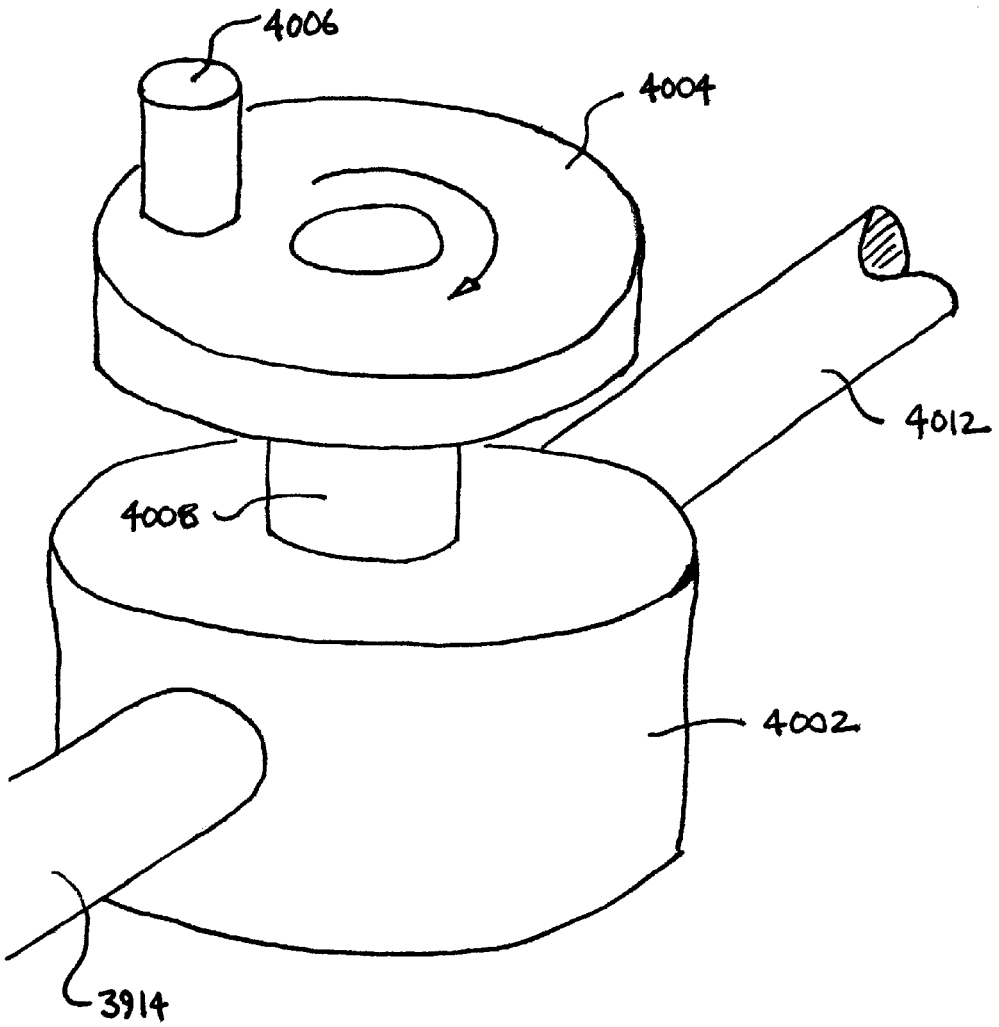
FIG. 41 is an isometric view of a preferred embodiment of a gearbox in accordance with the present invention.

Preferably, gear boxes 4002 are mounted on mount 3908 and are disposed beneath drive plate 3902. As shown in FIGS. 40 and 41, gear boxes 4002 preferably receive a rotating shaft input 3914 and then direct the rotating shaft 90° upwards. Preferably, a cam 4004 accepts the output 4008 of gear box 4002. Cam 4004 preferably includes an offset pin 4006 designed to move drive plate 3902 in a circular, orbiting motion. Offset pin 4006 is preferably received in corresponding holes 4010 disposed in drive plate 3902. Suitable bearings are disposed either on offset pin 4006 or in holes 4010 to permit relative rotation between offset pin 4006 and drive plate 3902.

In some embodiments, structures similar to gearbox 4002, cam 4004 and offset pin 4006 can be used as bearing surfaces 3910 to provide additional support to drive plate 3902 while, at the same time, permitting relative motion between drive plate 3902 and mount 3908.

If more than one gear box is used, a connecting shaft 4012 is used to transmit rotational power from one gear box to another. Connecting shaft 4012 can be either monolithic or separate shafts.

The foregoing disclosure of the preferred embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. An apparatus for moving a mass comprising:

a spiral track;

a first arm assembly having a first fulcrum and a first front end;

a second arm assembly having a second fulcrum and a second front end;

wherein the distance between the first fulcrum and the second fulcrum is less than the length of the first arm assembly.

2. The apparatus according to claim 1, wherein a first support is used to connect the first arm assembly to the spiral track and wherein a second support is used to connect the second arm assembly to the spiral track.

3. The apparatus according to claim 2, wherein a distance between the first support and the second support is less than the length of the first arm assembly.

4. The apparatus according to claim 2, wherein the first support is tapered.

5. The apparatus according to claim 1, wherein the first arm assembly includes only upper arms.

6. The apparatus according to claim 1, wherein the first arm assembly includes only lower arms.

7. An apparatus capable of moving a mass comprising:

a spiral track;

a first arm assembly connected to the spiral track and having an upper arm, the upper arm having a first end and a second end;

the first arm assembly also having a lower arm, the lower arm having a first end and a second end; and wherein the second end of the upper arm is separated from the second end of the lower arm.

8. The apparatus according to claim 7, wherein the upper arm is connected to a first axle and the lower arm is connected to a second axle wherein the first axle is spaced from the second axle resulting in a space between the upper arm and the lower arm.

9. The apparatus according to claim 7, wherein the first end of the upper arm is configured to engage a track.

10. The apparatus according to claim 7, wherein the first end of the lower arm is configured to engage a track.

11. The apparatus according to claim 7, wherein the second end of the upper arm includes a counterweight.

12. The apparatus according to claim 7, wherein the second end of the lower arm includes a counterweight.

13. The apparatus according to claim 7, wherein the upper arm is tapered.

14. The apparatus according to claim 7, wherein the lower arm is tapered.

15. An apparatus capable of moving a mass comprising:

a spiral track;

a first arm assembly connected to the spiral track and having at least one arm;

the arm having a first width proximate a first end and a second width proximate a second end;

wherein the first width is different than the second width.

16. The apparatus according to claim 15, wherein the arm includes a tapered region.

17. The apparatus according to claim 15, wherein the arm includes a pivot region.

18. The apparatus according to claim 15, wherein the arm includes a tapered region disposed between the first and second ends.

19. The apparatus according to claim 15, wherein the arm includes a pivot region disposed between the first and second ends.

20. An apparatus capable of moving a mass comprising:

a spiral track;

a first arm assembly connected to the spiral track and having at least one arm, a portion of the first arm assembly capable of rotating with the arm, the motion of the portion defining a circle;

a second arm assembly connected to the spiral track and having at least one arm;

wherein a portion of the second arm passes within the circle.

21. The apparatus according to claim 20, wherein the portion of the first arm is proximate to a first end.

22. The apparatus according to claim 20, wherein the first arm assembly includes only upper arms.

23. The apparatus according to claim 20, wherein the first arm assembly includes only lower arms.

24. The apparatus according to claim 20, wherein successive arms are staggered.

25. The apparatus according to claim 20, wherein the stagger comprises an upper arm followed by a lower arm.

* * * * *